US009164407B2

(12) United States Patent
Yamada et al.

(10) Patent No.: US 9,164,407 B2
(45) Date of Patent: Oct. 20, 2015

(54) ELECTROSTATIC LATENT IMAGE DEVELOPER

(71) Applicant: KONICA MINOLTA, INC., Chiyoda-ku (JP)

(72) Inventors: Chiaki Yamada, Ibaraki (JP); Masahiro Anno, Sakai (JP); Mikihiko Sukeno, Ashiya (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/270,545

(22) Filed: May 6, 2014

(65) Prior Publication Data

US 2014/0342281 A1 Nov. 20, 2014

(30) Foreign Application Priority Data

May 14, 2013 (JP) ..... 2013-101942

(51) Int. Cl.

| | |
|---|---|
| ***G03G 9/13*** | (2006.01) |
| ***G03G 9/08*** | (2006.01) |
| ***G03G 9/087*** | (2006.01) |
| ***G03G 9/09*** | (2006.01) |
| ***G03G 9/097*** | (2006.01) |

(52) U.S. Cl.

CPC ..... *G03G 9/08* (2013.01); *G03G 9/0874* (2013.01); *G03G 9/08791* (2013.01); *G03G 9/09* (2013.01); *G03G 9/0926* (2013.01); *G03G 9/09733* (2013.01)

(58) Field of Classification Search

CPC ..... G03G 9/135; G03G 9/1355

See application file for complete search history.

(56) References Cited

U.S. PATENT DOCUMENTS

| | | | |
|---|---|---|---|
| 5,700,618 | A | 12/1997 | Faust et al. |
| 5,714,296 | A | 2/1998 | Faust et al. |
| 2007/0218380 | A1 | 9/2007 | Uchinokura et al. |
| 2009/0221739 | A1 | 9/2009 | Knischka et al. |

FOREIGN PATENT DOCUMENTS

| | | | |
|---|---|---|---|
| EP | 0 683 437 | A1 | 11/1995 |
| EP | 0 719 804 | A2 | 7/1996 |
| JP | 2007279707 | A | 10/2007 |
| JP | 2008527130 | A | 7/2008 |
| JP | 2012097129 | A | 5/2012 |
| JP | 2013205593 | A | 10/2013 |

OTHER PUBLICATIONS

Japanese Office Action dated Mar. 31, 2015 issued in corresponding Japanese Patent Appln. No. 2013-101942, with English translation (7 pages).

*Primary Examiner* — Hoa V Le

(74) *Attorney, Agent, or Firm* — Buchanan Ingersoll & Rooney PC

(57) ABSTRACT

An electrostatic latent image developer of the present invention includes a resin, a colorant and a colorant dispersant, wherein the colorant dispersant contains a first polymer compound containing a constitutional unit derived from a monomer A, a constitutional unit derived from a monomer B and a constitutional unit derived from a monomer C, the monomer A is 4-vinylpyridine, the monomer B is $CH_2{=}CR^1{-}COOR^2$ (where $R^1$ represents hydrogen or a methyl group; and $R^2$ represents an alkyl group having 1 to 10 carbon atoms), and the monomer C is $CH_2{=}CR^3{-}COOR^4$ (where $R^3$ represents hydrogen or a methyl group; $R^4$ represents $(CH_2CH_2O)_nCH_3$ or $(CH_2CH_2O)_nCH_2CH_3$; and n represents an integer of 12 to 18).

5 Claims, 2 Drawing Sheets

ELECTROSTATIC LATENT IMAGE DEVELOPER

This application is based on Japanese Patent Application No. 2013-101942 filed with the Japan Patent Office on May 14, 2013, the entire content of which is hereby incorporated by reference.

BACKGROUND OF THE INVENTION

1. Field of the Invention

The present invention relates to an electrostatic latent image developer.

2. Description of the Related Art

Electrostatic latent image developers include toner particles containing at least a resin and a colorant, and reduction of the deposition amount of toner particles on a recording material such as paper is required due to the requirement of reducing costs, improving image quality and reducing fixation energy, etc.

However, reduction of the deposition amount of toner particles causes a decrease in image density, and therefore the added amount (ratio) of a colorant (pigment) in toner particles should be increased for retaining a proper image density. Accordingly, attempts are being made to increase the concentration of a colorant in toner particles, but when the concentration of a colorant is increased, the colorant is aggregated in toner particles (the secondary particle size is increased), so that it is difficult to uniformly disperse the colorant.

For liquid developers, that is one type of electrostatic latent image developer, various dispersants for adequately dispersing toner particles in an insulating liquid have been devised, and for example, in Japanese Laid-Open Patent Publication No. 07-319222, a block copolymer composed of a monomer containing a pyridine group and an acrylate-based monomer is proposed as such a dispersant. However, this is intended for dispersing toner particles themselves, and is a technique that is completely different from a technique for uniformly dispersing a colorant in toner particles.

SUMMARY OF THE INVENTION

When a colorant is not uniformly dispersed in toner particles, neither a proper color phase nor an image density (ID) corresponding to an added amount of the colorant can be obtained. Generally, when the ratio of a colorant in toner particles is increased, the fixation strength tends to decrease because the ratio of a resin becomes relatively low.

Particularly, the tendency of a decrease in fixation strength significantly depends on the dispersion state of a colorant, and when the dispersion state is deteriorated, the fixation strength further markedly decreases.

The present invention has been devised for solving the above-mentioned problems, and an object of the present invention is to provide an electrostatic latent image developer that gives a proper image density, a good color phase and a sufficient fixation strength even when containing a colorant in a high concentration.

The present inventor has intensively conducted studies for solving the above-mentioned problems, and resultantly found that it is effective that as a colorant dispersant, one having a specific structure is employed. The present invention has been completed by further conducting studies based on this finding.

That is, the electrostatic latent image developer of the present invention includes a resin, a colorant and a colorant dispersant, the colorant dispersant contains a first polymer compound containing a constitutional unit derived from a monomer A, a constitutional unit derived from a monomer B and a constitutional unit derived from a monomer C, the monomer A is 4-vinylpyridine, the monomer B is $CH_2{=}CR^1{-}COOR^2$ (where $R^1$ represents hydrogen or a methyl group; and $R^2$ represents an alkyl group having 1 to 10 carbon atoms), and the monomer C is $CH_2{=}CR^3{-}COOR^4$ (where $R^3$ represents hydrogen or a methyl group; $R^4$ represents $(CH_2CH_2O)_nCH_3$ or $(CH_2CH_2O)_nCH_2CH_3$; and n represents an integer of 12 to 18).

Here, preferably the monomer A is 4-vinylpyridine, the monomer B is n-butyl acrylate or n-butyl methacrylate, and the monomer C is $CH_2{=}CR^3{-}COOR^4$ (where $R^3$ represents hydrogen or a methyl group; and $R^4$ represents $(CH_2CH_2O)_{15}CH_3$).

Preferably the resin is a polyester resin having an acid value of 2 to 50 mgKOH/g. Preferably the colorant dispersant contains a second polymer compound that is a basic polymer compound containing a constitutional unit derived from ε-caprolactone, and preferably the second polymer compound is contained in an amount of 5 to 200% by mass with respect to the first polymer compound.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
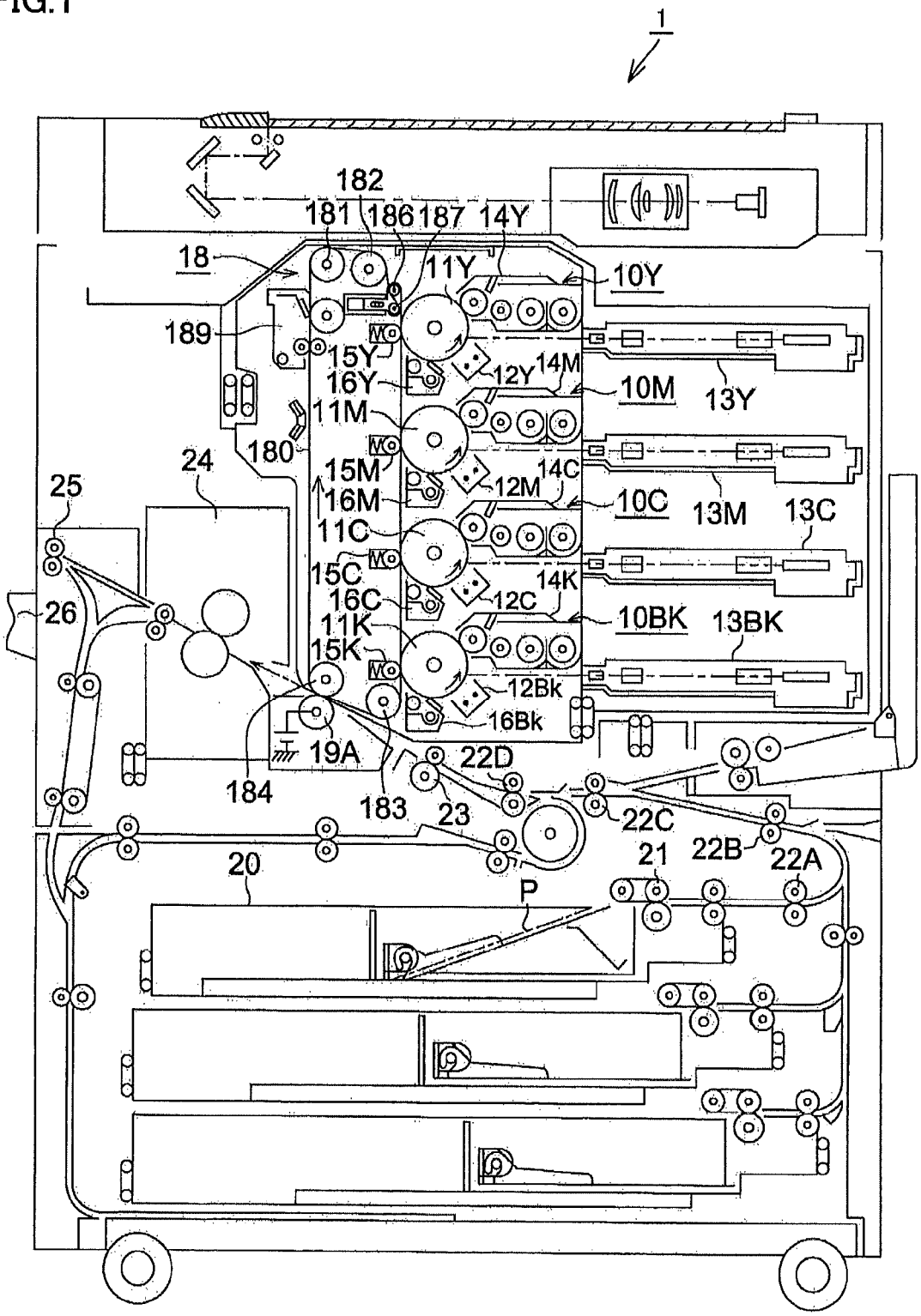
FIG. 1 is a schematic conceptual view of an electrophotographic image forming apparatus using a dry developer.

Embodiments according to the present invention will be described further in detail below.

<Electrostatic Latent Image Developer>

An electrostatic latent image developer of this embodiment includes a resin, a colorant and a colorant dispersant, wherein the colorant dispersant contains a first polymer compound containing a constitutional unit derived from a monomer A, a constitutional unit derived from a monomer B and a constitutional unit derived from a monomer C, the monomer A is 4-vinylpyridine, the monomer B is $CH_2{=}CR^1{-}COOR^2$ (where $R^1$ represents hydrogen or a methyl group; and $R^2$ represents an alkyl group having 1 to 10 carbon atoms), and the monomer C is $CH_2{=}CR^3{-}COOR^4$ (where $R^3$ represents hydrogen or a methyl group; $R^4$ represents $(CH_2CH_2O)_nCH_3$ or $(CH_2CH_2O)_nCH_2CH_3$; and n represents an integer of 12 to 18).

Such an electrostatic latent image developer (hereinafter, also referred to simply as a "developer") generally includes a dry developer and a liquid developer (also referred to as a wet developer). Further, the dry developer includes a one-component developer and a two-component developer. The one-component developer is made of toner particles. The two-component developer is made of toner particles and a carrier, and the toner particle is made of a toner matrix particle and an external additive (an external additive particle and a metal oxide particle). On the other hand, the liquid developer includes an insulating liquid and toner particles.

In this specification, the "toner particle," when simply called as such, refers to the above-mentioned toner particle or toner matrix particle unless otherwise specified. Three essential components including the resin, the colorant and the colorant dispersant contained in the electrostatic latent image developer are generally contained in toner particles (toner matrix particles for the two-component developer).

The electrostatic latent image developer may include optional previously known additives such as a wax and a charge control agent in addition to the three essential components described above. These optional additives may be contained in toner particles, or may be contained in other components. The liquid developer may further include a toner dispersant (a dispersant for dispersing toner particles themselves rather than a colorant dispersant contained in toner particles) and a thickener in an insulating liquid.

The above-mentioned electrostatic latent image developer is intended for forming (realizing) images by developing electrostatic latent images formed by various means, and is used principally as a developer for an electrophotographic image forming apparatus, but the application of the electrostatic latent image developer is not limited thereto.

As an example of the application, the electrostatic latent image developer can be used as, for example, a developer for electrophotography to be used in an electrophotographic image forming apparatus such as a copier, a printer, a digital printer or a simplified printer, a paint, a developer for electrostatic recording, an oil-based ink for inkjet printers, or an ink for electronic paper.

Components included in the electrostatic latent image developer will be described below.

<Colorant Dispersant>

The colorant dispersant included in the electrostatic latent image developer of this embodiment is characterized in that it contains a first polymer compound containing a constitutional unit derived from a monomer A, a constitutional unit derived from a monomer B and a constitutional unit derived from a monomer C, the monomer A is 4-vinylpyridine, the monomer B is $CH_2{=}CR^1{-}COOR^2$ (where R' represents hydrogen or a methyl group; and $R^2$ represents an alkyl group having 1 to 10 carbon atoms), and the monomer C is $CH_2{=}CR^3{-}COOR^4$ (where $R^3$ represents hydrogen or a methyl group; $R^4$ represents $(CH_2CH_2O)_nCH_3$ or $(CH_2CH_2O)_nCH_2CH_3$; and n represents an integer of 12 to 18).

By including the above-mentioned colorant dispersant, the electrostatic latent image developer of this embodiment exhibits an excellent effect of giving a proper image density, a good color phase and a high fixation strength. This is because by employing the first polymer compound as the colorant dispersant, a colorant is uniformly dispersed in a resin even when the colorant is contained in a high concentration although the mechanism thereof is not unknown yet. That is, such a colorant dispersant exists in a resin together with a colorant and acts to improve dispersibility of the colorant.

For example, by using the first polymer compound, aggregation of a colorant in a colorant dispersion can be prevented (i.e. the secondary particle size of the colorant can be decreased) and the viscosity of the colorant dispersion can be set to fall within a preferred range during a period of time until formation of toner particles after preparation of the colorant dispersion in a production process of the electrostatic latent image developer, and this preferred state can be stably maintained for a long period of time, for example, for several days to several months (i.e. a change with time can be extremely reduced).

Here, the first polymer compound may be a random copolymer, or may be a block copolymer or a graft copolymer. A constitutional unit derived from a monomer other than the monomer A, the monomer B and the monomer C may be contained. The number average molecular weight (Mn) of the compound is preferably 5000 to 50000, more preferably 10000 to 30000.

The constitutional units contained in the first polymer compound will be described below.

First, the phrase "containing a constitutional unit derived from a monomer A, a constitutional unit derived from a monomer B and a constitutional unit derived from a monomer C" means that the monomer A, the monomer B and the monomer C are polymerized to form the first polymer compound, and the first polymer compound as a polymerization reaction product thereof (i.e. a polymer) contains chemical structures derived from the monomers as constitutional units. For example, where 4-vinylpyridine as the monomer A is represented by "$CH_2{=}CHR_p$" ($R_p$ is a pyridine group), the chemical structure of "$-CH_2-CHR_p-$" as a constitutional unit derived from the monomer A exists in the first polymer compound. Thus, the monomers will be described below.

The monomer A is 4-vinylpyridine.

The monomer B is $CH_2{=}CR^1{-}COOR^2$ (where $R^1$ represents hydrogen or a methyl group; and $R^2$ represents an alkyl group having 1 to 10 carbon atoms). Here, $R^2$ may be a linear alkyl group, or may be a branched alkyl group. The number of carbon atoms of the alkyl group is more preferably 1 to 10. In particular, the monomer B is preferably n-butyl acrylate or n-butyl methacrylate.

The monomer C is $CH_2{=}CR^3{-}COOR^4$ (where $R^3$ represents hydrogen or a methyl group; $R^4$ represents $(CH_2CH_2O)_nCH_3$ or $(CH_2CH_2O)_nCH_2CH_3$; and n represents an integer of 12 to 18. The integer n is more preferably 12 to 15. The monomer C is more preferably $CH_2{=}CR^3{-}COOR^4$ (where $R^3$ represents hydrogen or a methyl group; and $R^4$ represents $(CH_2CH_2O)_{15}CH_3$.

Thus, the first polymer compound is preferably one containing a constitutional unit derived from a monomer A, a constitutional unit derived from a monomer B and a constitutional unit derived from a monomer C wherein the monomer A is 4-vinylpyridine, the monomer B is n-butyl acrylate or n-butyl methacrylate, and the monomer C is $CH_2{=}CR^3{-}COOR^4$ (where $R^3$ represents hydrogen or a methyl group; and $R^4$ represents $(CH_2CH_2O)_{15}CH_3$).

The ratios of the constitutional unit derived from the monomer A, the constitutional unit derived from the monomer B and the constitutional unit derived from the monomer C in the first polymer compound are not particularly limited, but it is preferred that the ratio of the constitutional unit derived from the monomer A is 20 to 30% by mole, more preferably 25 to 30% by mole, the ratio of the constitutional unit derived from the monomer B is 40 to 55% by mole, more preferably 45 to 50% by mole, and the ratio of the constitutional unit derived from the monomer C is 20 to 35% by mole, more preferably 22 to 30% by mole.

The first polymer compound can be produced by, for example, free radical polymerization. The polymerization reaction can be carried out by a continuous process, a batch process or a semi-continuous process. It is advantageous to carry out the polymerization reaction by precipitation polymerization, emulsion polymerization, solution polymerization, bulk polymerization or gel polymerization. Particularly, solution polymerization is advantageous.

As a solution for the polymerization reaction, all organic or inorganic solvents that are substantially inactive to a free radical polymerization reaction can be used, and examples thereof include ethyl acetate, n-butyl acetate and 1-methoxy-2-propyl acetate, and alcohols, for example, ethanol, i-propanol, n-butanol, isobutanol, 2-ethylehexanol and 1-methoxy-2-propanol as well as diols, for example, ethylene glycol and propylene glycol. Ketones, for example, acetone, butanone, pentanone, hexanone and methyl ethyl ketone, and alkyl esters of acetic acid, propionic acid and butyric acid, for example, ethyl acetate, butyl acetate and amyl acetate, and ethers, for example, tetrahydrofuran, diethyl ether, and monoalkyl ethers and dialkyl ethers of ethylene glycol and polyethylene glycol can be used. Aromatic solvents, for example, toluene, xylene and high-boiling-point alkyl benzenes can also be used.

The polymerization reaction is preferably carried out at atmospheric pressure or under reduced pressure or elevated pressure at a temperature in a range of 0 to 180° C., more preferably 10 to 100° C. If appropriate, the polymerization may be carried out under a protective gas atmosphere, preferably under a nitrogen atmosphere.

The polymerization can be induced using a high-energy ray, an electromagnetic wave, mechanical energy or a common chemical polymerization initiator, for example, an organic peroxide, for example, benzoyl peroxide, tert-butyl hydroperoxide, methyl ethyl ketone-peroxide, Cumoyl peroxide or dilauroyl peroxide (DLP), or an azo initiator, for example, azodiisobutyronitrile (AIBN), azobisamidepropylhydrochloride (ABAH) and 2,2'-azobis(2-methylbutyronitrile) (AMBN).

As a molecular weight control agent, a common compound is used. Examples of the appropriate common control agent include alcohols, for example, methanol, ethanol, propanol, isopropanol, n-butanol, sec-butanol and amyl alcohol, aldehydes, ketones, alkyl thiols, for example, dodecyl thiol and tert-dodecyl thiol, thioglycolic acid, isooctyl thioglycolate, and some halogen compounds, for example, carbon tetrachloride, chloroform and methylene chloride.

On the other hand, preferably the above-mentioned colorant dispersant contains the following second polymer compound together with the first polymer compound described above. That is, the second polymer compound is a basic polymer compound containing a constitutional unit derived from ϵ-caprolactone. When the colorant dispersant contains the above-mentioned second polymer compound, dispersibility of the colorant in the resin is further improved.

Here, the phrase "containing a constitutional unit derived from ϵ-caprolactone" means that in a basic polymer compound that is a polymer formed by polymerization (including ring-opening polymerization and polycondensation) of monomers, ϵ-caprolactone is contained as at least one of such monomers, and ϵ-caprolactone becomes a constitutional unit of the polymer (i.e. basic polymer compound) (i.e. it has the same meaning as that of the constitutional unit from the monomer A as described in connection with the above-mentioned first polymer compound). The "basic polymer compound" mentioned here refers to a polymer compound having a basic group in the molecule, and the basic group refers to an amine group, an amino group, an amide group, a pyrrolidone group, an imine group, an imino group, a urethane group, a quaternary ammonium group, an ammonium group, a pyridino group, a pyridium group, an imidazolino group, an imidazolium group or the like.

Therefore, more specific examples of the "basic polymer compound containing a constitutional unit derived from ϵ-caprolactone" may include polymer compounds containing a constitutional unit derived from ϵ-caprolactone as a basic backbone (e.g. a main chain) and having the above-mentioned basic groups. Specific examples may include polycaprolactones having the above-mentioned basic groups, and polycaprolactone-urethane graft polymers having the above-mentioned basic groups. The ratio and position of the basic group contained in the polymer compound are not particularly limited. The number average molecular weight of the second polymer compound is preferably 5000 to 50000, more preferably 10000 to 30000.

For example, the second polymer compound can be produced in the following manner. That is, the second polymer compound can be synthesized by, for example, a method in which α-amino-ϵ-caprolactam obtained by a dehydration reaction of lysine is reacted with a saturated fatty acid having 3 to 31 carbon atoms, preferably 7 to 19 carbon atoms, more preferably 9 to 17 carbon atoms and/or a derivative thereof to convert the α-amino group in α-amino-ϵ-caprolactam to a fatty acid amide group.

The α-amino-ϵ-caprolactam may be an optically active substance, or a racemic body. The α-amino-ϵ-caprolactam is preferably an optically active substance, more preferably an L-isomer.

Specific examples of the saturated fatty acid or a derivative thereof to be used when the α-amino group of the α-amino-ϵ-caprolactam is converted to a fatty acid amide group include octanoic acid, pelargonic acid, capric acid, undecylic acid, lauric acid, tridecylic acid, myristic acid, pentadecylic acid, palmitic acid, heptadecylic acid, stearic acid, arachic acid, 2-ethylhexanoic acid, 3,5,5-trimethylhexanoic acid, isomyristic acid, isopalmitic acid, and acid chlorides corresponding to these saturated fatty acids. These saturated fatty acids or derivatives thereof may be used alone or used as a mixture of two or more thereof.

The method for reacting the α-amino-ϵ-caprolactam with the saturated fatty acid and/or a derivative thereof is not particularly limited, and a previously known amidation method can be employed. For example, α-amino-ϵ-caprolactam may be reacted with the saturated fatty acid and/or a derivative thereof in an inert solvent in the absence of a catalyst, or in the presence of a catalyst such as a condensing agent. The reaction temperature is usually 10 to 120° C., and the reaction time is usually 0.5 to 48 hours. When an unreacted raw material, a solvent or the like is mixed in a reaction product, a step of purifying the reaction product by distillation under reduced pressure, solvent separation, recrystallization or the like can be employed.

Examples of the commercial product of the basic polymer compound containing a constitutional unit derived from ϵ-caprolactone may include "AJISPER PB821" (trade name), "AJISPER PB822" (trade name) and "AJISPER PB881" (trade name) from Ajinomoto Fine-Techno Co., Inc.

The colorant dispersant can be contained in the electrostatic latent image developer in a ratio of 1 to 100% by mass, preferably 1 to 40% by mass, based on the total mass of the colorant. When the content of the colorant dispersant is less than 1% by mass, dispersibility of the colorant may be poor, and when the content of the colorant dispersant is more than 100% by mass, the viscoelasticity of toner particles after toner formation may be reduced. The first polymer compound is contained in the colorant dispersant preferably in an amount of 30 to 100% by mass, further preferably 33 to 80% by mass.

When the colorant dispersant contains the first polymer compound and the second polymer compound, the content of the second polymer compound is not particularly limited, but it is preferred that the second polymer compound is contained in an amount of 5 to 200% by mass, more preferably 30 to 200% by mass based on the amount of the first polymer compound. When the content of the second polymer compound is less than 5% by mass, a change in color phase may occur because temporal stability of the pigment dispersion is not satisfactory, and when the content is more than 200% by mass, a desired image density may not be obtained because pigment dispersibility is not satisfactory.

One type of the first polymer compound, or two or more types of the first polymer compounds may be contained in the colorant dispersant. When the second polymer compound is contained in the colorant dispersant, one type thereof, or two or more types thereof may be contained. In this case, when the polymer compounds have different chemical structures (types of the constitutional unit), they are considered to be different in type, but even those that are considered to be identical in chemical structure should be considered to be different in type when they are different in number average molecular weight by 500 or more. The chemical structures of the first polymer compound and the second polymer compound can be identified by NMR, etc., and the number average molecular weight can be measured in the same manner as in the case of the number average molecular weight of a resin described later.

The colorant dispersant may contain other dispersants, for example, previously known dispersants in addition to the first polymer compound and the second polymer compound.

<Colorant>

The colorant included in the electrostatic latent image developer is dispersed in the resin. As the colorant, previously known pigments, etc. can be used without being particularly limited, but from the viewpoint of costs, light resistance, colorability, etc., for example, the following pigments are preferably used. These pigments are usually classified into the black pigment, the yellow pigment, the magenta pigment and the cyan pigment in terms of color structure, and in principle, colors other than black (color images) are formulated by subtractive color mixture of the yellow pigment, the magenta pigment and the cyan pigment.

For the black pigment, for example, carbon black such as furnace black, channel black, acetylene black, thermal black and lamp black, and magnetic powders such as magnetite and ferrite can be used.

Examples of the magenta pigment may include C.I. Pigment Red 2, 3, 5, 6, 7, 15, 16, 48:1, 53:1, 57:1, 60, 63, 63, 64, 68, 81, 83, 87, 88, 89, 90, 112, 114, 122, 123, 139, 144, 149, 150, 163, 166, 170, 177, 178, 184, 202, 206, 207, 209, 222, 238 and 269. The "C.I." herein refers to a "color index."

Examples of the yellow pigment may include C.I. Pigment Orange 31 and 43, and Pigment Yellow 12, 14, 15, 17, 74, 83, 93, 94, 138, 155, 162, 180 and 185.

Examples of the cyan pigment may include C.I. Pigment Blue 2, 3, 15, 15:2, 15:3, 15:4, 16, 17, 60, 62 and 66 and C.I. Pigment Green 7.

Examples of the colorant as a dye may include C.I. Solvent Red 1, 49, 52, 58, 63, 111 and 122, C.I. Solvent Yellow 2, 6, 14, 15, 16, 19, 21, 33, 44, 56, 61, 77, 79, 80, 81, 82, 93, 98, 103, 104, 112 and 162, and C.I. Solvent Blue 25, 36, 60, 70, 93 and 95.

These colorants may be used alone or in combination of two or more thereof as necessary. The added amount of the colorant may be in a range of 1 to 50% by mass, preferably 8 to 40% by mass, based on the total mass of the toner particles. When the added amount of the colorant is less than 1% by mass, a sufficient coloring effect may not be obtained, and when the added amount of the colorant is more than 50% by mass, it may become difficult to uniformly disperse the colorant, leading to reduction of glossiness due to aggregation of the colorant.

The primary particle size of the colorant varies according to the type, but is preferably about 10 to 200 nm in general. When the primary particle size is more than 200 nm, dispersibility of the colorant tends to be deteriorated, so that a desired color phase may not be obtained. Further, glossiness is reduced, so that a desired image density cannot be obtained, and further the fixing property may be deteriorated.

<Resin>

The resin to be included in the electrostatic latent image developer may be any resin as long as it acts to fix principally the colorant on a recording material, and is thermoplastic. Examples may include vinyl-based resins such as those of styrene, acrylic and vinyl acetate, polyester, polyurethane, epoxy, polyethylene and petroleum-based resins.

Among the resins shown above as examples, a polyester resin having an acid value is particularly preferred. In this case, the acid value is preferably 2 to 50 mgKOH/g. That is, the acid value is preferably greater than or equal to 2 mgKOH/g, more preferably greater than or equal to 10 mgKOH/g. When the acid value is greater than or equal to 2 mgKOH/g, the fixing property can be improved because affinity between a recording material such as paper and the resin is high, and when the acid value is less than 2 mgKOH/g, the fixation strength may not be sufficient because affinity between a recording material such as paper and the resin is low. The acid value is preferably less than or equal to 50 mgKOH/g, and when the acid value is more than 50 mgKOH/g, the fixing property may be deteriorated because control of the molecular weight of the resin is so difficult that a desired molecular weight is not obtained.

The reason why a polyester resin is preferred is that its properties such as a thermal property can be widely changed and the polyester resin is excellent in light permeability, spreadability and viscoelasticity. Since the polyester resin is excellent in light permeability as described above, a beautiful color can be obtained when a color image is formed. Further, since the polyester resin is excellent in spreadability and viscoelasticity, an image (resin film) formed on a recording material such as paper is tough and can be strongly bonded to the recording material.

The number average molecular weight of the polyester resin is preferably greater than or equal to 500 and less than or equal to 100000, more preferably greater than or equal to 1000 and less than or equal to 50000. When the molecular weight is in the above-mentioned range, moderate meltability and offset resistance are obtained. The polyester resin is included in one or both of a core and a shell when the resin has a core-shell structure as described later.

The polyester resin is made from an acid component (polybasic acid) and an alcohol component (polyhydric alcohol). Here, the polyhydric alcohol is not particularly limited, and examples thereof include alkylene glycols (aliphatic glycols) such as ethylene glycol, diethylene glycol, triethylene glycol, propylene glycols such as 1,2-propylene glycol, dipropylene glycol, butanediols such as 1,4-butanediol, neopentyl glycol and hexanediols such as 1,6-hexanediol and alkylene oxide adducts thereof; phenol-based glycols of bisphenols such as bisphenol A and hydrogenated bisphenol and alkylene oxide adducts thereof; cycloaliphatic and aromatic diols such as monocycle or polycyclic diols; and triols such as glycerin and trimethylolpropane. They may be used alone or used as a mixture of two or more thereof. Particularly, a 2- to 3-mol-alkylene oxide adduct of bisphenol A is preferred because it is suitable as a resin for toner particles in a liquid developer from the viewpoint of solubility of a polyester resin as a product, and stability, and its low cost. Examples of the alkylene oxide include ethylene oxide and propylene oxide.

Examples of the polybasic acid (polycarboxylic acid) include malonic acid, succinic acid, adipic acid, azelaic acid, sebacic acid, fumaric acid, maleic acid, itaconic acid, phthalic acid and modified acids thereof (e.g. hexahydrophthalic anhydride), saturated or unsaturated (or aromatic) polyvalent basic acids such as isophthalic acid, terephthalic acid, trimellitic acid, trimeric acid and pyromellitic acid, and acid anhydrides and lower alkyl esters thereof, and they may be used alone or used as a mixture of two or more thereof. Among them, isophthalic acid, terephthalic acid and trimellitic acid are preferred because they are suitable as a resin for toner particles in a liquid developer from the viewpoint of solubility of a polyester resin as a product, and stability, and their low cost. Particularly, use of trimellitic acid having a functional group with a functionality of 3 or more is advantageous because the acid value is improved.

<Production Method>

Methods for production of a dry developer and a liquid developer will be described below as a method for production of the electrostatic latent image developer of this embodiment.

<Method for Production of Dry Developer>

First, a method for production of toner matrix particles of a two-component developer will be described as a method for production of a dry developer.

First, the method for production of such toner matrix particles (hereinafter, referred to simply as toner particles because they are toner particles before an external additive is added, but to be exact, toner particles of a two-component developer are made from toner matrix particles and an external additive) is not particularly limited, and any of previously known methods for production of toner particles can be employed. The toner matrix particles can be prepared by, for example, the so-called grinding method in which toner particles are prepared through kneading, grinding and classification steps, and the so-called polymerization method in which a polymerizable monomer is polymerized, and simultaneously particles are formed while controlling the shape and size.

Among them, preparation of particles by the polymerization method is capable of forming desired toner particles while controlling the shape and size of particles in the production process, and is most suitable for preparation of small-size toner particles that can accurately reproduce very small dot images. The polymerization method is most suitable particularly when it is required to produce toner matrix particles of core-shell structure, the surfaces of which are smooth, and it is preferred that the surfaces of core particles are made smooth for forming smooth toner particle surfaces with shells.

As a method for production of toner particles which satisfy the above-mentioned requirement, it is preferred to employ an emulsification association method in which resin particles of about 200 nm are formed beforehand by a polymerization method, particularly an emulsification polymerization method or a suspension polymerization method, and the resin particles are aggregated and fused together to form particles. That is, in the emulsification association method, core particles having smooth surfaces can be prepared by controlling conditions for a resin particle aggregating and fusing step and a subsequent aging step. An example of preparation of toner particles containing a resin of core-shell structure by the emulsification association method will be described below.

In the emulsification association method, toner particles are prepared generally through the following procedures. That is, (1) core forming resin particle dispersion preparing step;
(2) colorant dispersion preparing step;
(3) core resin particle aggregating and fusing step;
(4) first aging step;
(5) shell formation step;
(6) second aging step;
(7) cooling step;
(8) washing step;
(9) drying step; and
(10) external additive treatment step.

In this embodiment, by setting the heating temperature higher and setting the fusing time longer in an aggregating and fusing step when core particles are prepared, aggregated resin particles are made to have a rounded shape, and also smooth surfaces are formed. Core particles having smooth surfaces can also be prepared by setting the heating temperature higher and setting the time longer in the first aging step of heating a reaction system subsequent to the aggregating and fusing step. The steps in a method for production of toner particles will be described below taking, as an example, toner particles having a core-shell structure in which the surfaces of core particles containing a polyester resin are coated with a modified polyester resin with a styrene-acrylic copolymer molecular chain bound to a polyester molecular chain terminal, but the type of resin is not limited thereto.

(1) Core Forming Resin Particle Dispersion Preparing Step

This step is a step of introducing a polymerizable monomer for forming core resin particles, and performing polymerization to form resin fine particles having a size of about 200 nm. In this step, at least a basic acid monomer having a high valence and a polyhydric alcohol monomer are introduced, these polymerizable monomers are polymerized by a polymerization initiator to synthesize a polyester resin, and the polyester resin is then dissolved in an organic solvent, phase-transferred into an aqueous medium and dispersed in the form of fine particles to prepare a dispersion of polyester resin fine particles.

(2) Colorant Dispersion Preparing Step

This step is a step of dispersing a colorant in an aqueous medium in the presence of a colorant dispersant to prepare a dispersion of colorant particles having a size of about 110 nm.

(3) Core Resin Particle Aggregating and Fusing Step (Formation of Core Particles)

This step is a step of aggregating the foregoing resin particles and colorant particles in an aqueous medium, and simultaneously fusing these particles together to prepare core particles. In this step, an alkali metal salt, an alkali earth metal salt or the like is added as a coagulant in an aqueous medium with resin particles mixed with colorant particles, the mixture is then heated at a temperature higher than or equal to the glass transition temperature of the resin particles, so that aggregation proceeds, and simultaneously the resin particles are fused together.

Specifically, by adding to a reaction system the resin particles and colorant particles prepared in the foregoing procedure, and adding a coagulant such as magnesium chloride, the resin particles and the colorant particles are aggregated, and simultaneously the particles are fused together to form aggregated resin particles (core particles). When the core particles have a desired size, a salt such as saline solution is added to stop aggregation.

In this step, when the heating temperature is set higher and the fusing time is set longer, the aggregated resin particles (core particles) have a rounded shape, and also have smooth surfaces. In this manner, core particles having smooth surfaces can be prepared.

(4) First Aging Step

This step is a step of heating the reaction system, subsequent to the aggregating and fusing step, to perform aging until core particles have a desired shape. In this step also, core particles having smooth surfaces can be prepared by setting the heating temperature higher and setting the treatment time longer.

(5) Shell Formation Step

This step is a step of adding shell forming resin particles in a dispersion of core particles formed in the first aging step to coat the surfaces of core particles with the resin particles, thereby forming shells. In this step, resin particles of a modified polyester with a styrene-acrylic copolymer molecular chain bound to a polyester molecular chain terminal can be added to form shells containing the modified polyester.

It is believed that since a modified polyester with a styrene-acrylic copolymer molecular chain bound to a polyester molecular chain is used for the shell forming resin, moderate affinity with the surfaces of core particles is exhibited to form a strong bond. It is believed that since moderate dispersibility is maintained among shell forming resin particles, aggregation of shell forming resin particles is hard to occur, so that thin shells are formed on the surfaces of core particles. In this manner, toner matrix particles of core-shell structure are formed.

(6) Second Aging Step

This step is a step of heating the reaction system, subsequent to the shell formation step, to strengthen coating of shells on core surfaces and perform aging until toner matrix particles have a desired shape.

(7) Cooling Step

This step is a step of cooling (rapidly cooling) the dispersion of toner matrix particles. As a cooling condition, cooling is performed at a rate of 1 to 20° C./min. The cooling method is not particularly limited, and examples thereof may include a method of performing cooling by introducing a cooling medium from outside a reaction vessel and a method of performing cooling by introducing cool water directly into a reaction system.

(8) Washing Step

This step includes a step of solid-liquid-separating toner matrix particles from the toner matrix particle dispersion cooled to a predetermined temperature in the above-mentioned step, and a washing step of removing deposits such as a surfactant and a coagulant from the surfaces of toner matrix particles that has been solid-liquid separated to be formed into a wet cake-shaped aggregate.

The washing treatment includes performing a water-washing treatment until the electric conductivity of a filtrate reaches the level of 10 μS/cm, for example. The filtration treatment method is not particularly limited, and examples thereof include known methods such as a centrifugal separation method, a vacuum filtration method that is carried out using Nutsche or the like, and a filtration method using a filter press or the like.

(9) Drying Step

This step is a step of drying the washed toner matrix particles to obtain dried toner matrix particles. Examples of the dryer to be used in this step include known dryers such as a spray dryer, a vacuum freeze dryer and a vacuum dryer, and a standing-shelf dryer, a moving-shelf dryer, a fluidized bed dryer, a rotary dryer, a stirring dryer or the like can also be used.

The amount of water contained in dried toner matrix particles is preferably less than or equal to 5% by mass, further preferably less than or equal to 2% by mass. When dried toner matrix particles are aggregated by a weak interparticle attractive force, the aggregate may be subjected to a crushing treatment. As a crushing treatment apparatus, a mechanical crushing apparatus such as a jet mill, a Henschel mixer, a coffee mill or a food processor can be used.

(10) External Additive Treatment Step

This step is a step of adding an external additive to the surfaces of dried toner matrix particles as necessary, and mixing the mixture to prepare toner particles. In this step, at least monodisperse spherical particles having a number average primary particle size of greater than or equal to 50 nm and less than or equal to 150 nm are added as an external additive.

Through the above steps, toner particles for a two-component developer, which contain toner matrix particles of core-shell structure, can be prepared by an emulsion association method.

Details of the coagulant, polymerization initiator, dispersion stabilizer, surfactant, etc. used in the above-mentioned steps are as follows.

First, the coagulant used in the above-mentioned steps is not particularly limited, and a metal salt such as an alkali metal salt or an alkali earth metal salt is preferred. Examples may include salts of monovalent metals, such as salts of alkali metals such as sodium, potassium and lithium, salts of divalent metals such as calcium, magnesium, manganese and copper, and salts of trivalent metals such as iron and aluminum. More specific examples may include sodium chloride, potassium chloride, lithium chloride, calcium chloride, magnesium chloride, zinc chloride, copper sulfate, magnesium sulfate and manganese sulfate and among them, salts of divalent metals are particularly preferred. When a salt of a divalent metal is used, aggregation can proceed with a smaller amount. These coagulants may be used alone or in combination of two or more thereof.

When the resin is formed using a vinyl-based polymerizable monomer as described above, a known oil-soluble or water-soluble polymerization initiator can be used as a polymerization initiator. Examples of the oil-soluble polymerization initiator may include azo-based or diazo-based polymerization initiators and peroxide-based polymerization initiators shown below. That is, examples of the azo-based or diazo-based polymerization initiator may include 2,2'-azobis-(2,4-dimethylvaleronitrile), 2,2'-azobis-isobutyronitrile, 1,1'-azobis(cyclohexane-1-carbonitrile), 2,2'-azobis-4-methoxy-2,4-dimethylvaleronitrile and azobis-isobutyronitrile. Examples of the peroxide-based polymerization initiator may include benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl)propane and tris-(t-butylperoxy)triazine.

A known chain transfer agent can also be used for adjusting the molecular weight of resin particles. Specific examples may include octyl mercaptan, dodecyl mercaptan, tert-dodecyl mercaptan, n-octyl-3-mercaptopropionic acid ester, terpinolene, carbon tetrabromide and α-methyl styrene dimer.

In the present invention, since a polymerizable monomer dispersed in an aqueous medium is polymerized, and resin particles dispersed in the aqueous medium are aggregated and fused together to prepare toner particles, it is preferred to use a dispersion stabilizer for stably dispersing the materials for toner particles in the aqueous medium. Examples of the dispersion stabilizer may include tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina. Compounds that are generally used as a surfactant, such as polyvinyl alcohol, gelatin, methyl cellulose, sodium dodecylbenzenesulfonate, ethylene oxide adducts and higher alcohol sodium sulfate, can also be used as a dispersion stabilizer.

Examples of the external additive (external additive particles and metal oxide particles) used in the above-mentioned steps may include AEROSIL R812, AEROSIL R812S, AEROSIL RX300, AEROSIL RY300, AEROSIL R976 and AEROSIL R976S (each manufactured by Nippon Aerosil Co., Ltd.) and X-24-9404 (manufactured by Shin-Etsu Chemical Co., Ltd.).

A two-component developer can be produced by mixing the toner particles produced as described above with a carrier.

As the carrier that forms a two-component developer, magnetic particles formed of previously known materials, such as metals such as iron, ferrite and magnetite, and alloys of these metals and metals such as aluminum and lead can be used, and particularly ferrite particles are preferably used.

As the carrier, those having a volume average particle size of 15 to 100 μm are preferred, and those having a volume average particle size of 25 to 60 μm are more preferred. The volume average particle size of the carrier can be measured typically by a laser diffraction-type particle size distribution measuring apparatus "HELOS"(manufactured by SYMPATEC Company) provided with a wet disperser.

As the carrier, it is preferred to use one further coated with a resin, or the so-called resin dispersion-type carrier with magnetic particles dispersed in a resin. This is because the resistance of the carrier is generally low, and the resistance can be adjusted to a desired value by coating the carrier with a resin. The coating resin composition is not particularly limited, and for example, an olefin-based resin, a styrene-based resin, a styrene-acrylic resin, a silicone-based resin, an ester-based resin, a fluorine-containing polymer-based resin or the like is used. The resin for forming the resin dispersion-type carrier is not particularly limited, and a known resin, for example, an acrylic resin, a styrene-acrylic resin, a polyester resin, a fluorine-based resin or a phenol-based resin can be used.

On the other hand, the one-component developer can be produced by a method similar to the method for production of toner matrix particles in the production of the toner particles.

Such a dry developer may optionally contain any previously known additives such as a wax, a charge control agent and an external additive in addition to three essential components including a resin, a colorant and a colorant dispersant.

Among these optional additives, examples of the wax include known waxes that are shown below. That is, (1) polyolefin-based waxes:
polyethylene wax, polypropylene wax, etc.

(2) long-chain hydrocarbon-based waxes:
paraffin wax, Sasol wax, etc.

(3) dialkyl ketone-based waxes:
distearyl ketone, etc.

(4) ester-based waxes:
carnauba wax, montan wax, trimethylolpropane tribehenate, pentaerythritol tetramyristate, pentaerythritol tetrastearate, pentaerythritol tetrabehenate, pentaerythritol diacetate dibehenate, glycerin tribehenate, 1,18-octadecanediol distearate, tristearyl trimellitate, distearyl maleate, etc.

(5) amide-based waxes:
ethylenediamine dibehenyl amid; tristearylamide trimellitate, etc.

The melting point of the wax is preferably 40 to 125° C., more preferably 50 to 120° C., further preferably 60 to 90° C. By ensuring that the melting point falls within the above-mentioned range, heat-resistant storage stability of toner particles is secured, and images can be stably formed by toner particles without causing a cold offset even when fixation is performed at a low temperature. The content of the wax in toner particles is preferably 1% by mass to 30% by mass, further preferably 5% by mass to 20% by mass.

<Method for Production of Liquid Developer>

The liquid developer includes an insulating liquid and toner particles. After the toner particles are produced by a method similar to the method for production of toner matrix particles of the two-component developer as described above, a liquid developer can be produced by dispersing the toner particles in an insulating liquid. The liquid developer may also be produced by forming toner particles in an insulating liquid.

The insulating liquid is preferably one having a resistance value that does not cause disorderliness of an electrostatic latent image (about $10^{11}$ to $10^{16}$ Ω·cm). Further, a solvent having slight odor and toxicity is preferred. Examples of the insulating liquid generally include aliphatic hydrocarbons, cycloaliphatic hydrocarbons, aromatic hydrocarbons, halogenated hydrocarbons and polysiloxane. Particularly, normal paraffin-based solvents and isoparaffin-based solvents are preferred from the viewpoint of odor, harmlessness and costs. Specific examples may include MORESCO WHITE (trade name, manufactured by MATSUMURA OIL RESEARCH CORPORATION), ISOPAR (trade name, manufactured by ExxonMobil Chemical Company), SHELLSOL (trade name, manufactured by Shell Petrochemicals Company), and IP SOLVENT 1620, IP SOLVENT 2028 and IP SOLVENT 2835 (trade names, each manufactured by Idemitsu Petrochemical Co., Ltd.).

In the insulating liquid, a dispersant (toner dispersant) soluble in the insulating liquid can be included for stably dispersing toner particles. The toner dispersant is not particularly limited in type as long as it causes toner particles to be stably dispersed. When the acid value of a polyester resin to be used as a resin included in toner particles is relatively high, it is preferred to use a basic polymer dispersant.

The toner dispersant may be one that is soluble in the insulating liquid, or one that is dispersible in the insulating liquid. Preferably, the toner dispersant is added to toner particles in an amount of 0.5% by mass to 20% by mass. When the added amount of the toner dispersant is less than 0.5% by mass, dispersibility is deteriorated, and when the added amount of the toner dispersant is more than 20% by mass, the fixation strength of toner particles may be reduced because the toner dispersant captures the insulating liquid.

EXAMPLES

The present invention will be described more in detail below by way of examples, but the present invention is not limited to these examples.

1. Preparation of Core Resin

A core-shell resin was employed as a resin (resin in toner particles) to be included in a dry developer as an electrostatic latent image developer. A method for preparation of a core resin of the core-shell resin will be shown below. The core resin is also a resin (resin in toner particles) to be included in a liquid developer.

<Preparation of Core Resin A>

In a round bottom flask equipped with a reflux condenser, a water-alcohol separator, a nitrogen gas introducing tube, a thermometer and a stirrer were added 1500 parts by mass of a 2-mol-propylene oxide adduct of bisphenol A (polyhydric alcohol), 500 parts by mass of terephthalic acid (polyvalent basic acid) and 300 parts by mass of trimellitic acid (polyvalent basic acid), and a nitrogen gas was introduced with stirring to perform dehydration polycondensation or dealcoholization polycondensation at a temperature of 200 to 240° C.

When the number average molecular weight of the produced polyester resin reached 2000, the temperature of the reaction system was reduced to 100° C. or lower to stop polycondensation. In this manner, a thermoplastic polyester resin (core resin A) was obtained. The obtained core resin A had a Mw of 5200, a Mn of 2200, a Tg of 55.3° C. and an acid value of 10.2 mgKOH/g.

<Preparation of Core Resin B>

In a round bottom flask equipped with a reflux condenser, a water-alcohol separator, a nitrogen gas introducing tube, a thermometer and a stirrer were added 1500 parts by mass of a 2-mol-propylene oxide adduct of bisphenol A (polyhydric alcohol), 400 parts by mass of terephthalic acid (polyvalent basic acid) and 500 parts by mass of trimellitic acid (polyvalent basic acid), and a nitrogen gas was introduced with stirring to perform dehydration polycondensation or dealcoholization polycondensation at a temperature of 200 to 240° C.

When the number average molecular weight of the produced polyester resin reached 1500, the temperature of the reaction system was reduced to 100° C. or lower to stop polycondensation. In this manner, a thermoplastic polyester resin (core resin B) was obtained. The obtained core resin A had a Mw of 4900, a Mn of 1800, a Tg of 57.4° C. and an acid value of 48.3 mgKOH/g.

<Preparation of Core Resin C>

In a round bottom flask equipped with a reflux condenser, a water-alcohol separator, a nitrogen gas introducing tube, a thermometer and a stirrer were added 1600 parts by mass of a 2-mol-propylene oxide adduct of bisphenol A (polyhydric alcohol), 820 parts by mass of terephthalic acid (polyvalent basic acid) and 100 parts by mass of trimellitic acid (polyvalent basic acid), and a nitrogen gas was introduced with stirring to perform dehydration polycondensation or dealcoholization polycondensation at a temperature of 200 to 240° C.

When the number average molecular weight of the produced polyester resin reached 2200, the temperature of the reaction system was reduced to 100° C. or lower to stop polycondensation. In this manner, a thermoplastic polyester resin (core resin C) was obtained. The obtained core resin C had a Mw of 5500, a Mn of 2400, a Tg of 53.8° C. and an acid value of 2.6 mgKOH/g.

<Preparation of Core Resin D>

In a round bottom flask equipped with a reflux condenser, a water-alcohol separator, a nitrogen gas introducing tube, a thermometer and a stirrer were added 1800 parts by mass of a 2-mol-propylene oxide adduct of bisphenol A (polyhydric alcohol), 860 parts by mass of terephthalic acid (polyvalent basic acid) and 50 parts by mass of trimellitic acid (polyvalent basic acid), and a nitrogen gas was introduced with stirring to perform dehydration polycondensation or dealcoholization polycondensation at a temperature of 200 to 240° C.

When the number average molecular weight of the produced polyester resin reached 2000, the temperature of the reaction system was reduced to 100° C. or lower to stop polycondensation. In this manner, a thermoplastic polyester resin (core resin D) was obtained. The obtained core resin D had a Mw of 5400, a Mn of 2200, a Tg of 54.8° C. and an acid value of 1.3 mgKOH/g.

<Method for Measurement of Physical Properties>

In this specification, various physical property values were measured in the following manner unless otherwise specified.

That is, the Mw (weight average molecular weight) and the Mn (number average molecular weight) were each calculated from the result of gel permeation chromatography. Gel permeation chromatography was performed using a high performance chromatograph pump (trade name: "TRI ROTAR-V Model," manufactured by JASCO Corporation), an ultraviolet spectroscopic detector (trade name: "(JVDEC 427-100-V Model," manufactured by JASCO Corporation) and a 50 cm-long column (trade name: "Shodex GPC A-803," manufactured by Showa Denko K.K.). From the result of chromatography, the molecular weight of a test sample was calculated with polystyrene as a standard substance to determine values as Mw and Mn in terms of polystyrene, and these values were employed as Mw and Mn, respectively. As the test sample, one obtained by dissolving 0.05 g of a resin in 20 ml of tetrahydrofuran (THF) was used.

The Tg (glass transition temperature) was measured under conditions of a sample amount of 20 mg and a temperature elevation rate of 10° C./min using a differential scanning calorimeter (trade name: "DSC-6200," manufactured by Seiko Instruments Inc.).

The acid value was measured under conditions in the JIS K5400 method.

The volume average particle size of toner particles was measured using a particle size distribution measuring apparatus (trade name: "FPIA-3000S," manufactured by Malvern Instruments Ltd).

2. Preparation of Shell Resin Particles

A method for preparation of a shell resin of the core-shell resin will be shown below.

In accordance with the following procedure, a dispersion of "shell resin particles 1" containing a styrene acrylic-modified polyester resin with a styrene-acrylic copolymer molecular chain bound to a polyester molecular chain terminal was prepared.

That is, 500 parts by mass of a 2-mol-propylene oxide adduct of bisphenol A, 154 parts by mass of terephthalic acid, 45 parts by mass fumaric acid and 2 parts by mass of tin octylate were added in a reaction vessel equipped with a nitrogen introducing device, a dehydration pipe, a stirrer and a thermocouple, a polycondensation reaction was performed at 230° C. for 8 hours, the polycondensation reaction was further continued at 8 kPa for 1 hour, and the reaction product was then cooled to 160° C. In this manner, a polyester molecule was formed.

Next, 10 parts by mass of acrylic acid was added at a temperature of 160° C., mixed and held for 15 minutes, and a mixture of 142 parts by mass of styrene, 35 parts by mass of n-butyl acrylate and 10 parts by mass of a polymerization initiator (di-t-butyl peroxide) was then added dropwise through a dropping funnel over 1 hour.

After the mixture was added, an addition polymerization reaction was performed for 1 hour with the temperature kept at 160° C., the temperature was then elevated to 200° C., and the mixture was held at 10 kPa for 1 hour. In this manner, a styrene acrylic-modified polyester resin containing a styrene-acrylic copolymer molecular chain in a ratio of 20% by mass was prepared.

Next, 100 parts by mass of the styrene acrylic-modified polyester resin was subjected to a grinding treatment using a commercially available grinding treatment apparatus (trade name: "RANDELL MILL" (Model: RM) manufactured by TOKUJU CORPORATION). Subsequently, the polyester resin was mixed with 638 parts by mass of an aqueous sodium lauryl sulfate solution (concentration: 0.26% by mass) prepared beforehand, and the mixture was subjected to an ultrasonic dispersion treatment at a V-Level of 300 μA for 30 minutes using an ultrasonic homogenizer (trade name: "US-150T," manufactured by NIHONSEIKI KAISHA LTD.) while the mixture was stirred. In this manner, a dispersion of "shell resin particles 1" formed of a styrene acrylic-modified polyester resin with the particles having a volume-based median diameter of 250 nm was prepared.

3. Preparation of First Polymer Compound as Colorant Dispersant

<Preparation of First Polymer Compound A>

A first polymer compound A was prepared in the following manner.

That is, 52.6 g of 4-vinylpyridine (molar mass: 105) as a monomer A, 128.2 g of $CH_2{=}CR^1COOR^2$ ($R^1$:H, $R^2$:$CH_2CH_2CH_2CH_3$) (molar mass: 128) as a monomer B, 373.4 g of $CH_2{=}CR^3COOR^4$ ($R^3$:H, $R^4$:$(CH_2CH_2O)_{15}CH_3$) (molar mass: 747) as a monomer C and 18.2 g of 1-dodecanethiol in 776 ml of tert-butanol were first added in a flask having a stirrer, a reflux condenser, an internal thermometer and a nitrogen inlet under a nitrogen atmosphere. Thereafter, the added components were heated to 90° C. with stirring. When a reaction temperature was reached, a solution of 15.4 g of an AMBN initiator in 166 ml of isobutanol was added over 1 hour. Subsequently, the mixture was stirred at this temperature for further 5 hours. After the mixture was cooled to room temperature, the solution was removed under reduced pressure.

The first polymer compound A thus prepared contained 25% by mole of a constitutional unit derived from the monomer A, 50% by mole of a constitutional unit derived from the monomer B and 25% by mole of a constitutional unit derived from the monomer C and had a Mn of 17300, wherein the monomer A is 4-vinylpyridine, the monomer B is $CH_2{=}CR^1{-}COOR^2$ (where $R^1$ represents hydrogen; and $R^2$ represents a n-butyl group), and the monomer C is $CH_2{=}CR^3{-}COOR^4$ (where $R^3$ represents hydrogen; and $R^4$ represents $(CH_2CH_2O)_{15}CH_3$).

<Preparation of First Polymer Compounds B to L and Comparative Polymer Compounds M to Q>

First polymer compounds B to L and comparative polymer compounds M to Q shown in Table 1 were obtained in the same manner as in preparation of the first polymer compound A described above except that the types and added amounts of the monomer A, the monomer B and the monomer C were changed. The first polymer compound A prepared as described above is also shown so that the items shown in Table 1 are clarified.

That is, in Table 1, "% by mole" in the column of each monomer indicates the ratio, in terms of % by mole, of the constitutional unit derived from each monomer in the first polymer compound (or a comparative polymer compound), and $R^1$ and $R^2$ in the column of the monomer B indicate $R^1$ and $R^2$, respectively, in $CH_2{=}CR'{-}COOR^2$. Similarly, $R^3$ and $R^4$ in the column of the monomer C indicate $R^3$ and $R^4$, respectively, in $CH_2{=}CR^3{-}COOR^4$. The column of Mn shows Mn of each first polymer compound (or a comparative polymer compound). In Table 1, the blank ("–") indicates that the concerned substance is not included.

TABLE 1

| | | Monomer A | | Monomer B | | | Monomer C | | | |
|---|---|---|---|---|---|---|---|---|---|---|
| | | Chemical name | % by mole | $R^1$ | $R^2$ | % by mole | $R^3$ | $R^4$ | % by mole | Mn |
| First polymer compound | A | 4-vinylpyridine | 25 | hydrogen | n-butyl group | 50 | hydrogen | $(CH_2CH_2O)_{15}CH_3$ | 25 | 17300 |
| | B | 4-vinylpyridine | 25 | methyl group | n-butyl group | 45 | hydrogen | $(CH_2CH_2O)_{12}CH_3$ | 30 | 11700 |
| | C | 4-vinylpyridine | 27 | hydrogen | n-butyl group | 45 | methyl group | $(CH_2CH_2O)_{12}CH_3$ | 28 | 15600 |
| | D | 4-vinylpyridine | 30 | methyl group | n-butyl group | 48 | methyl group | $(CH_2CH_2O)_{15}CH_3$ | 22 | 9200 |
| | E | 4-vinylpyridine | 25 | hydrogen | n-butyl group | 45 | hydrogen | $(CH_2CH_2O)_{12}CH_2CH_3$ | 30 | 7500 |
| | F | 4-vinylpyridine | 28 | hydrogen | s-butyl group | 52 | methyl group | $(CH_2CH_2O)_{18}CH_2CH_3$ | 20 | 20200 |
| | G | 4-vinylpyridine | 28 | methyl group | s-butyl group | 50 | methyl group | $(CH_2CH_2O)_{15}CH_2CH_3$ | 22 | 19800 |
| | H | 4-vinylpyridine | 20 | hydrogen | methyl group | 50 | hydrogen | $(CH_2CH_2O)_{18}CH_3$ | 30 | 18100 |
| | I | 4-vinylpyridine | 20 | methyl group | methyl group | 55 | methyl group | $(CH_2CH_2O)_{12}CH_3$ | 25 | 14400 |
| | J | 4-vinylpyridine | 25 | hydrogen | n-hexyl group | 40 | methyl group | $(CH_2CH_2O)_{15}CH_2CH_3$ | 35 | 16200 |
| | K | 4-vinylpyridine | 25 | methyl group | n-decyl group | 40 | hydrogen | $(CH_2CH_2O)_{15}CH_2CH_3$ | 35 | 9400 |
| | L | 4-vinylpyridine | 25 | hydrogen | n-decyl group | 45 | hydrogen | $(CH_2CH_2O)_{12}CH_2CH_3$ | 30 | 8200 |
| Comparative polymer compound | M | 4-vinylpyridine | 30 | hydrogen | n-butyl group | 70 | — | — | 0 | 13400 |
| | N | 4-vinylpyridine | 40 | — | — | 0 | hydrogen | $(CH_2CH_2O)_{15}CH_3$ | 60 | 17000 |
| | O | — | 0 | methyl group | n-butyl group | 50 | hydrogen | $(CH_2CH_2O)_{12}CH_3$ | 50 | 19100 |
| | P | 4-vinylpyridine | 25 | methyl group | $(CH_2)_{10}CH_3$ | 50 | hydrogen | $(CH_2CH_2O)_{12}CH_3$ | 25 | 8700 |
| | Q | 4-vinylpyridine | 25 | methyl group | n-butyl group | 50 | hydrogen | $(CH_2CH_2O)_{20}CH_3$ | 25 | 17700 |

4. Preparation of Colorant Dispersion

<Preparation of Colorant Dispersion Y1>

In 80 parts by mass of acetone were dissolved 3 parts by mass of the first polymer compound A as a colorant dispersant and 1 part by mass of AJISPER PB822 (manufactured by Ajinomoto Fine-Techno Co., Inc.) as a second polymer compound to obtain an aqueous solution containing a colorant dispersant. While this aqueous solution was stirred, 16 parts by mass of a yellow pigment (C.I. Pigment Yellow 185, trade name: "PALIOTOL YELLOW D 1155," manufactured by BASF Ltd.) was slowly added to obtain a mixed liquid.

Then, this mixed liquid was subjected to a dispersion treatment using a stirrer (trade name: "CLEARMIX," manufactured by M Technique Co., Ltd.), thereby preparing a "colorant dispersion Y1."

<Preparation of Colorant Dispersions Y2 to Y23, C1 to C4 and M1 to M3>

Colorant dispersions Y2 to Y23, C1 to C4 and M1 to M3 shown in Table 2 were prepared in the same manner as in the case of the colorant dispersion Y1. The colorant dispersion Y1 prepared as described above is also shown so that the items shown in Table 2 are clarified.

TABLE 2

| Colorant dispersion | | Colorant | First polymer compound | Second polymer compound | Solvent |
|---|---|---|---|---|---|
| Example | Y1 | PY185(16) | A(3) | PB822(1) | acetone |
| | Y2 | PY185(16) | A(3.8) | PB822(0.2) | acetone |
| | Y3 | PY185(16) | B(2) | PB821(2) | acetone |
| | Y4 | PY185(16) | C(1.35) | PB881(2.65) | acetone |
| | Y5 | PY185(16) | A(1.25) | PB822(2.75) | acetone |
| | Y6 | PY185(16) | A(4) | — | acetone |
| | Y7 | PY180(16) | B(3.5) | PB822(0.5) | acetone |
| | Y8 | PY74(16) | C(3.8) | PB822(0.2) | acetone |
| | Y9 | PY185(16) | G(3) | PB822(1) | acetone |
| | Y10 | PY185(16) | H(3.2) | PB881(0.8) | acetone |
| | Y11 | PY180(16) | J(4) | — | acetone |
| | Y12 | PY185(16) | K(3) | PB821(1) | acetone |
| | Y13 | PY185(16) | L(4) | — | acetone |
| | Y14 | PY185(16) | A(3) | PB822(1) | water |
| | Y15 | PY185(16) | B(4) | — | water |
| | Y16 | PY180(16) | C(3) | PB822(1) | water |
| | Y17 | PY74(16) | E(3) | PB822(1) | water |
| | C1 | PB15:3(16) | D(3.2) | PB821(0.8) | acetone |
| | C2 | PB15:3(16) | E(1.25) | PB821(2.75) | acetone |
| | C3 | PB15:3(16) | I(3) | PB822(1) | acetone |
| | M1 | PR122(16) | A(2.8) | PB822(1.2) | acetone |
| | M2 | PR122(16) | F(4) | — | acetone |
| Comparative Example | Y18 | PY185(16) | M(3) | PB822(1) | acetone |
| | Y19 | PY185(16) | N(3) | PB822(1) | acetone |
| | Y20 | PY185(16) | O(3) | PB822(1) | acetone |
| | Y21 | PY185(16) | — | PB822(4) | acetone |
| | Y22 | PY185(16) | M(3) | PB822(1) | water |
| | Y23 | PY185(16) | — | PB822(4) | water |
| | C4 | PB15:3(16) | P(3) | PB822(1) | acetone |
| | M3 | PR122(16) | Q(3) | PB822(1) | acetone |

In the column of the solvent in Table 2, "acetone" indicates a dispersion formed by dispersing a colorant in acetone, such as the colorant dispersion Y1, and "water" indicates a dispersion formed by dispersing a colorant in ion-exchanged water in place of acetone. Details of abbreviations in the column of the colorant are as follows. The alphabets in the column of the first polymer compound indicate the type of the first polymer compound prepared as described above, and the blank ("—") indicates that the first polymer compound is not contained.

Details of abbreviations in the column of the second polymer compound are shown.

"PB822": a basic polymer compound containing a constitutional unit derived from ε-caprolactone (trade name: "AJISPER PB822," manufactured by Ajinomoto Fine-Techno Co., Inc.)

"PB821": a basic polymer compound containing a constitutional unit derived from ε-caprolactone (trade name: "AJISPER PB821," manufactured by Ajinomoto Fine-Techno Co., Inc.)

"PB881": a basic polymer compound containing a constitutional unit derived from ε-caprolactone (trade name: "AJISPER PB881," manufactured by Ajinomoto Fine-Techno Co., Inc.)

The blank ("—") indicates that the second polymer compound is not contained.

The value in the parentheses in each of the columns of the colorant, the first polymer compound and the second polymer compound indicates the content of these components in terms of % by mass (the balance of % by mass is constituted of the solvent).

In Table 2, the colorant dispersions Y1 to Y17, C1 to C3 and M1 and M2 correspond to examples of the present invention because they contain the first polymer compound of the present invention as a colorant dispersant. On the other hand, the colorant dispersions Y18 to Y23, C4 and M3 correspond to comparative examples because they do not contain the first polymer compound of the present invention. M, N, O, P and Q described in the column of the first polymer compound are comparative polymer compounds as is apparent from Table 1.

Details of abbreviations in the column of the colorant are shown below,

"PY185": a yellow pigment (C.I. Pigment Yellow 185, trade name: "PALIOTOL YELLOW D 1155," manufactured by BASF Ltd.)

"PY180": a yellow pigment (C.I. Pigment Yellow 180, trade name: "Toner Yellow HG," manufactured by Clariant (Japan) K.K.)

"PY74": a yellow pigment (C.I. Pigment Yellow 74, trade name: "HANSA BRILL. YELLOW 5GX01," manufactured by Clariant (Japan) K.K.)

"PB15:3": a cyan pigment (C.I. Pigment Blue 15:3, trade name: "Fastogen Blue GNPT," manufactured by DIC Corporation)

"PR122": a magenta pigment (C.I. Pigment Red 122, trade name: "FASTOGEN Super Magenta RTS," manufactured by DIC Corporation)

5. Preparation of Toner Matrix Particles

Toner matrix particles to be included in a two-component developer (dry developer) as an electrostatic latent image developer were prepared as described below.

<Preparation of Toner Matrix Particles 1>

In a reaction vessel equipped with an anchor blade for giving stirring power, 500 parts by mass of methyl ethyl ketone and 100 parts by mass of isopropyl alcohol were added, 560 parts by mass of the core resin A coarsely ground by a hammer mill was then added gradually, the mixture was stirred, dissolved or dispersed to obtain an oil phase. Then, 30 parts by mass of a 0.1 mol/L aqueous ammonia solution was added dropwise to the oil phase that was being stirred, and the oil phase was added dropwise to 500 parts by mass of ion-exchanged water to subject the oil phase to phase-transfer emulsification. A solvent was then removed by reducing the pressure with an evaporator to obtain a dispersion of core resin A fine particles, and the dispersion was adjusted so as to have a solid content (core resin A fine particles) of 40% by mass by adding ion-exchanged water thereto, thereby obtaining a core resin fine particle dispersion A1.

In a reaction vessel equipped with a temperature sensor, a cooling pipe, a nitrogen introducing device and a stirrer were put 1,400 parts by mass of the core resin fine particle dispersion A1, 360 parts by mass of the colorant dispersion Y14, 5 parts by mass of an anionic surfactant "NEOGEN RK" (manufactured by Dai-ichi Kogyo Seiyaku Co., Ltd.), and 300 parts by mass of ion-exchanged water, and the mixture was stirred. The temperature of the inside of the vessel was adjusted to 30° C., and 1.0% by mass of an aqueous nitric acid solution was then added to the solution to adjust the pH to 3.0.

Then, the temperature was elevated to 47° C. while particles were dispersed by a homogenizer "ULTRA-TURRAX T50" (manufactured by IKA), and the particle size was measured using "MULTISIZER 3" (manufactured by Beckman Coulter, Inc.). When the volume-based median diameter (D50) of aggregated particles reached 5.5 μm, 300 parts by mass of the dispersion of the shell resin particles 1 prepared as described above was added, and heating/stirring was continued until the shell resin particles 1 were deposited on the surfaces of aggregated particles. A small amount of the reaction solution was taken out, and subjected to centrifugal separation, and when the supernatant became clear, an aqueous solution formed by dissolving 150 parts by mass of sodium chloride in 600 parts by mass of ion-exchanged water was added to stop growth of particles. Further, as an aging treatment, heating/stirring was performed with the liquid temperature kept at 90° C., so that fusion of particles was made to proceed. In this state, measurement was performed using a particle size distribution measuring apparatus (trade name: "FPIA-3000S," manufactured by Sysmex Corporation), and fusion of particles was made to proceed until the average circularity reached 0.965.

Thereafter, the liquid was cooled to a temperature of 30° C., the pH of the liquid was adjusted to 2 using hydrochloric acid, and stirring was stopped. In this manner, a toner matrix particle dispersion 1 was prepared.

Subsequently, the toner matrix particle dispersion 1 was subjected to solid-liquid separation using a basket type centrifugal separator (trade name: "MARKIII" (Model No. 60×40), manufactured by MATSUMOTO KIKAI MFG. Co., LTD.), thereby forming a wet cake of toner matrix particles 1.

The wet cake was washed with ion-exchanged water at 45° C. using the basket type centrifugal separator until the electric conductivity of a filtrate reached 5 μS/cm. Thereafter, the wet cake was transferred to a dryer (trade name: "Flash Jet Dryer," manufactured by SEISHIN ENTERPRISE Co., Ltd.), and dried until the water content became 0.5% by mass, thereby preparing "toner matrix particles 1" having a volume-based median diameter of 5.7 μm.

The toner matrix particles 1 have a yellow pigment (C.I. Pigment Yellow 185) dispersed as a colorant principally in the core resin A in the presence of the first polymer compound A shown in Table 1 and the second polymer compound, and include three essential components of the present invention.

<Preparation of Toner Matrix Particles 2 to 6>

Toner matrix particles 2 to 6 were prepared in the same manner as in the case of the toner matrix particles 1 except that in place of "560 parts by mass of the core resin A and 360 parts by mass of the colorant dispersion Y14" that were first added in the reaction vessel, those in Table 3 below were used in preparation of the toner matrix particles 1. The toner matrix particles 1 prepared as described above are also shown so that the items shown in Table 3 are clarified.

TABLE 3

| Toner matrix particles | Core resin | Colorant dispersion |
|---|---|---|
| 1 | A(560) | Y14(360) |
| 2 | A(560) | Y15(360) |
| 3 | D(560) | Y16(400) |
| 4 | B(560) | Y17(360) |
| 5 | A(560) | Y22(360) |
| 6 | A(560) | Y23(360) |
| 7 | A(560) | Y14(360) |
| 8 | A(560) | Y15(360) |
| 9 | D(560) | Y16(400) |
| 10 | B(560) | Y17(360) |
| 11 | A(560) | Y22(360) |
| 12 | A(560) | Y23(360) |

In Table 3, the alphabets in the column of the core resin indicate the type of the core resin prepared as described above, and the values in the parentheses indicate the number of parts by mass of a core resin used. The abbreviations in the column of the colorant dispersion indicate the type of the colorant dispersion prepared as described above, and the values in the parentheses indicate the number of parts by mass of a colorant dispersion used.

<Preparation of Toner Matrix Particles 7 to 12>

In the toner matrix particles 1 to 6 prepared as described above, the colorant dispersion was used immediately after being prepared. On the other hand, toner matrix particles 7 to 12 were prepared in the same manner as in the case of the toner matrix particles 1 to 6 except that the colorant dispersion was used ten days after being prepared instead of using the colorant dispersant immediately after being prepared in the toner matrix particles 1 to 6.

That is, the toner matrix particles 7 correspond to toner matrix particles obtained using the colorant dispersion Y14 ten days after being prepared instead of using the colorant dispersion Y14 immediately after being prepared for the toner matrix particles 1, and likewise toner matrix particles 8 to 12 were prepared in correspondence with the toner matrix particles 2 to 6 in the numerical order (e.g. the toner matrix particles 8 correspond to toner matrix particles obtained using the colorant dispersion Y15 ten days after being prepared instead of using the colorant dispersion Y15 immediately after being prepared for the toner matrix particles 2, and the toner matrix particles 12 correspond to toner matrix particles obtained using the colorant dispersion Y23 ten days after being prepared instead of using the colorant dispersion Y23 immediately after being prepared for the toner matrix particles 6).

6. Preparation of Toner Particles

Toner particles to be included in a two-component developer (dry developer) as an electrostatic latent image developer were prepared as described below.

<Preparation of Toner Particles 1>

To 100 parts by mass of the "toner matrix particles 1" prepared as described above, 1.0 part by mass of external additive particles (trade name: "AEROSIL R812," manufactured by Nippon Aerosil Co., Ltd.) and 1.5 parts by mass of metal oxide particles (trade name: "X-24-9404," manufactured by Shin-Etsu Chemical Co., Ltd.) were added, and an external addition treatment was performed with the stirring blade circumferential speed set to 40 in/second, the treatment temperature set to 30° C. and the treatment time set to 20 minutes in a Henschel mixer (trade name: "FM10B," manufactured by Mitsui Miike Machinery Co., Ltd.). Thereafter, "toner particles 1" were prepared by removing coarse particles using a sieve with a mesh size of 90 μm.

<Preparation of Toner Particles 2 to 12>

Toner particles 2 to 12 were prepared in the same manner as in the case of the "toner particles 1" except that the "toner matrix particles 1" used as described above were replaced by the toner matrix particles 2 to 12, respectively.

That is, the toner matrix particles 2 were used for the toner particles 2, and likewise in the numerical order, the toner matrix particles 12 were used for the toner particles 12.

7. Preparation of Resin-Coated Carrier

A resin-coated carrier was prepared in accordance with the following procedure.

<Provision of Ferrite Core Material Particles>

As ferrite core material particles for a resin-coated carrier, ferrite particles having a volume average particle size of 35 μm (trade name: "EF47," manufactured by Powdertech Co., Ltd.) were provided. The ferrite particles were of Mn—Mg—Sr type. The volume average particle size was measured by a commercially available laser diffraction-type particle size distribution measuring apparatus (trade name "HELOS," manufactured by SYMPATEC Company) provided with a wet disperser.

<Preparation of Coating Resin Particles>

A reaction vessel equipped with a stirrer, a temperature sensor, a cooling pipe and a nitrogen introducing device was charged with an aqueous surfactant solution formed by dissolving 1.7 parts by mass of sodium dodecyl sulfate in 3000 parts by mass of ion-exchanged water. The internal temperature was elevated to 80° C. while the aqueous surfactant solution was stirred at a stirring speed of 230 rpm under a nitrogen stream.

Then, an initiator solution formed by dissolving 10 parts by mass of potassium persulfate (KPS) in 400 parts by mass of ion-exchanged water was added into the aqueous surfactant solution, and a monomer mixed liquid including 400 parts by mass of cyclohexyl methacrylate and 400 parts by mass of methyl methacrylate was added dropwise over 2 hours with the liquid temperature kept at 80° C.

Thereafter, the mixture was heated and stirred at a liquid temperature of 80° C. for 2 hours to perform a polymerization reaction, thereby preparing a dispersion of coating resin particles. The dispersion was dried by a spray dryer to prepare coating resin particles.

<Preparation of Resin-Coated Carrier>

In a horizontal rotary blade type mixer were added 3000 parts by mass of the ferrite core material particles provided as described above and 120 parts by mass of the coating resin particles prepared as described above, and mixed/stirred at a temperature of 22° C. for 15 minutes with the circumferential speed of a horizontal rotary blade set at 4 m/second. Thereafter, the mixture was heated to 120° C. and stirred for 40 minutes in this state to prepare a resin-coated carrier having a volume average particle size of 36 μm.

8. Preparation of Dry Developer

A dry developer as a two-component developer including toner particles and a carrier was prepared as described below.

<Preparation of Dry Developer 1>

By mixing 7 parts by mass of the "toner particles 1" prepared as described above with 93 parts by mass of the resin-coated carrier prepared as described above, a "dry developer 1" with a toner particle concentration of 7.0% by mass was obtained.

<Preparation of Dry Developers 2 to 12>

Dry developers 2 to 12 were prepared in the same manner as in the case of the "dry developer 1" except that the "toner particles 1" used as described above were replaced by the toner particles 2 to 12, respectively.

That is, the toner particles 2 were used for the dry developer 2, and likewise in the numerical order, the toner particles 12 were used for the dry developer 12.

9. Preparation of Liquid Developer

A liquid developer as an electrostatic latent image developer was prepared as described below. The liquid developer has toner particles dispersed in an insulating liquid.

<Preparation of Liquid Developer 1>

First, 1500 parts by mass of acetone, 555 parts by mass of the "core resin A" prepared as described above, 1875 parts by mass of the "colorant dispersion Y1" prepared as described above, and 3500 parts by mass of glass beads were mixed, the mixture was dispersed for 3 hours using a paint conditioner, and the glass beads were then removed to prepare a resin dissolving liquid X with a colorant dispersed therein.

Then, a solution of 14 parts by mass of a N-vinylpyrrolidone/alkylene copolymer (trade name: "Antaron V-216," manufactured by GAF/ISP Chemicals Corporation) in 800 parts by mass of an insulating liquid (trade name: "IP SOLVENT 2028" manufactured by Idemitsu Petrochemical Co., Ltd.) was added to 786 parts by mass of the resin dissolving liquid X as a toner disperser, and a homogenizer was started to disperse the mixture for 10 minutes, thereby preparing a liquid developer precursor.

Subsequently, the liquid developer precursor was freed of acetone by an evaporator, and then stored in a thermostatic bath at 50° C. for 5 hours to prepare a "liquid developer 1." The average particle size was 2.2 μm.

The liquid developer 1 includes toner particles, a toner dispersant and an insulating liquid, has a yellow pigment (CI Pigment Yellow 185) dispersed as a colorant in the core resin A in toner particles in the presence of the first polymer compound A shown in Table 1 and the second polymer compound PB822, and includes three essential components of the present invention.

The volume average particle size of toner particles in the liquid developer was measured using a particle size distribution measuring apparatus (trade name: "FPIA-3000S," manufactured by Malvern Instruments Ltd).

<Preparation of Liquid Developers 2 to 26>

Liquid developers 2 to 26 were prepared in the same manner as in the case of the liquid developer 1 except that in place of "1500 parts by mass of acetone, 555 parts by mass of the core resin A and 1875 parts by mass of the colorant dispersion Y1," those in Table 4 below were used in preparation of the liquid developer 1. The liquid developer 1 prepared as described above is also shown so that the items shown in Table 4 are clarified.

TABLE 4

| Liquid developer | Acetone | Core resin | Colorant dispersion |
|---|---|---|---|
| 1 | 1500 | A(555) | Y1(1875) |
| 2 | 1500 | A(555) | Y2(1875) |
| 3 | 1500 | A(555) | Y3(1875) |
| 4 | 1500 | A(555) | Y4(1875) |
| 5 | 1500 | A(555) | Y5(1875) |
| 6 | 1500 | A(555) | Y6(1875) |
| 7 | 1400 | B(530) | Y7(2000) |
| 8 | 1500 | C(555) | Y8(1875) |
| 9 | 1500 | D(555) | Y1(1875) |
| 10 | 1500 | D(555) | Y6(1875) |
| 11 | 2000 | A(680) | C1(1250) |
| 12 | 2000 | A(680) | C2(1250) |
| 13 | 1800 | A(630) | M1(1500) |

TABLE 4-continued

| Liquid developer | Acetone | Core resin | Colorant dispersion |
|---|---|---|---|
| 14 | 1800 | A(630) | M2(1500) |
| 15 | 1500 | A(555) | Y9(1875) |
| 16 | 1500 | A(555) | Y10(1875) |
| 17 | 2000 | A(680) | C3(1250) |
| 18 | 1400 | A(530) | Y11(2000) |
| 19 | 1500 | D(555) | Y12(1875) |
| 20 | 1500 | D(555) | Y13(1875) |
| 21 | 1500 | A(555) | Y18(1875) |
| 22 | 1500 | A(555) | Y19(1875) |
| 23 | 1500 | A(555) | Y20(1875) |
| 24 | 2000 | A(680) | C4(1250) |
| 25 | 1800 | A(630) | M3(1500) |
| 26 | 1500 | A(555) | Y21(1875) |

In Table 4, the values in the column of acetone indicate the number of parts by mass of acetone. The alphabets in the column of the core resin indicate the type of the core resin prepared as described above, and the values in the parentheses indicate the number of parts by mass of a core resin used. The abbreviations in the column of the colorant dispersion indicate the type of the colorant dispersion prepared as described above, and the values in the parentheses indicate the number of parts by mass of a colorant dispersion used.

<Preparation of Liquid Developers 27 to 52>

In the liquid developers 1 to 26 prepared as described above, the colorant dispersion was used immediately after being prepared. On the other hand, liquid developers 27 to 52 were prepared in the same manner as in the case of the liquid developers 1 to 26 except that the colorant dispersion was used ten days after being prepared instead of using the colorant dispersant immediately after being prepared in the liquid developers 1 to 26.

That is, the liquid developer 27 corresponds to a liquid developer obtained using the colorant dispersion Y1 ten days after being prepared instead of using the colorant dispersion Y1 immediately after being prepared for the liquid developer 1, and likewise the liquid developers 28 to 52 were prepared in correspondence with the liquid developers 2 to 26 in the numerical order (e.g. the liquid developer 28 corresponds to a liquid developer obtained using the colorant dispersion Y2 ten days after being prepared instead of using the colorant dispersion Y2 immediately after being prepared for the liquid developer 2, and the liquid developer 52 corresponds to a liquid developer obtained using the colorant dispersion Y21 ten days after being prepared instead of using the colorant dispersion Y21 immediately after being prepared for the liquid developer 26).

10. Formation of Image

The following images were formed using the dry developers 1 to 12 and the liquid developers 1 to 52 prepared as described above.

That is, continuous printing of 1000 sheets was performed for each developer under an environment with a temperature of 25° C. and a relative humidity of 60% RH. Images were prepared by continuous printing such that person face photograph images, halftone images with a relative reflection density of 0.4, white background images and solid images with a relative reflection density of 1.3 were output onto an A4-size recording material (fine quality paper) in a quartered manner. The relative reflection density of the halftone image and the solid image was measured by a Macbeth transmission reflection densitometer (trade name: "SpectroEye," manufactured by X-Rite Inc.).

After the continuous printing of 1000 sheets, 10 sheets of A4-size solid images were subsequently formed, and used as images for evaluation as described below.

Figure 2:
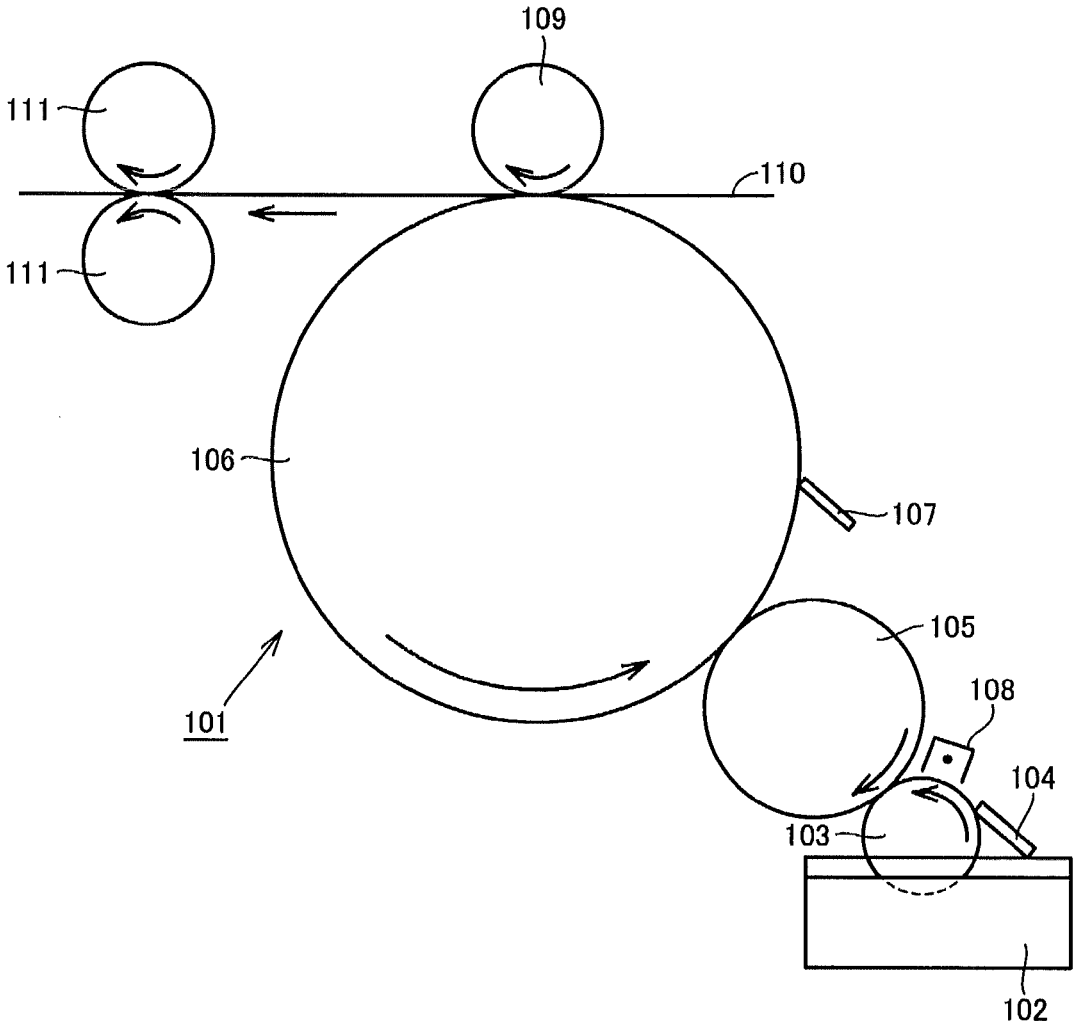
FIG. 2 is a schematic conceptual view of an electrophotographic image forming apparatus using a liquid developer.

The formation of images described above was performed using an image forming apparatus shown in FIG. 1 (e.g. a two-component development type image forming apparatus multifunction printer (trade name: "bizhub PRO V6500,"

manufactured by KONICA MINOLTA BUSINESS TECHNOLOGY, INC.) for the dry developers 1 to 12, and using an image forming apparatus shown in FIG. 2 for the liquid developers 1 to 52.

Process conditions and the outline of the process in image forming apparatuses of FIGS. 1 and 2 are as follows.

<Outline of Process in Image Forming Apparatus of FIG. 1>

FIG. 1 is a schematic conceptual view of an electrophotographic image forming apparatus 1. Image forming apparatus 1 of FIG. 1 forms yellow, magenta, cyan and black toner images on photoreceptors in image forming units 10Y, 10M, 10C and 10BK. The toner images formed on the photoreceptors in the image forming units are transferred onto an endless belt that forms an intermediate transfer body unit 18, so that the toner images are superimposed on one another (primary transfer). In this manner, full color toner images can be formed in intermediate transfer body unit 18 (in this example, each dry developer was filled only in an image forming unit of the corresponding color (one color)). The toner image formed by transferring and superimposing images in intermediate transfer body unit 18 is transferred onto an image support P (secondary transfer), and melted and solidified to be fixed on image support P by a fixation device 24.

Image forming unit 10Y that forms a yellow image as one of toner images of different colors, which are formed in the photoreceptors, includes a drum-shaped photoreceptor 11Y as a first image carrier, a charger 12Y disposed on the circumference of photoreceptor 11Y, an exposure unit 13Y, a development unit 14Y, a primary transfer roll 15Y as a primary transfer means and a cleaning unit 16Y. Image forming unit 10M that forms a magenta image as another one of toner images of different colors includes a drum-shaped photoreceptor 11M as a first image carrier, a charger 12M disposed on the circumference of photoreceptor 11M, an exposure unit 13M, a development unit 14M, a primary transfer roll 15M as a primary transfer means and a cleaning unit 16M.

Image forming unit 10C that forms a cyan image as still another one of toner images of different colors includes a drum-shaped photoreceptor 11C as a first image carrier, a charger 12C disposed on the circumference of photoreceptor 11C, an exposure unit 13C, a development unit 14C, a primary transfer roll 15C as a primary transfer means and a cleaning unit 16C. Image forming unit 10BK that forms a black image as still another one of toner images of different colors includes a drum-shaped photoreceptor 11K as a first image carrier, a charger 12Bk disposed on the circumference of photoreceptor 11K, an exposure unit 13BK, a development unit 14K, a primary transfer roll 15K as a primary transfer means and a cleaning unit 16Bk.

Endless belt-shaped intermediate transfer body unit 18 includes an endless belt-shaped intermediate transfer body 180 as a second image carrier in the form of an intermediate transfer endless belt, which is wound by a plurality of rolls and rotatably supported.

Images of respective colors formed by image forming units 10Y, 10M, 10C and 10BK are sequentially transferred onto rotating endless belt-shaped intermediate transfer body unit 18 by primary transfer rolls 15Y, 15M, 15C and 15K, so that a synthesized color image is formed. Image support P such as paper as a recoding material stored in a sheet feeding cassette 20 is fed by a sheet feeding and delivering unit 21, and delivered through a plurality of intermediate rolls 22A, 22B, 22C and 22D and a resist roll 23 to a secondary transfer roll 19A as a secondary transfer means, so that color images are collectively transferred onto image support P. Image support P, to which color images (only one color in this example) have been transferred, are fixed by thermal roll type fixation device 24, held in a sheet discharge roll 25, and placed on a sheet discharge tray 26 outside the apparatus.

On the other hand, endless belt-shaped intermediate transfer body unit 18, from which image support P has been curvedly separated after images are transferred to image support P by secondary transfer roll 19A, is freed of residual toners by a cleaning unit 189.

Primary transfer roll 15K is always in pressure contact with photoreceptor 11K throughout image formation processing. Other primary transfer rolls 15Y, 15M and 15C are in pressure contact with Corresponding photoreceptors 11Y, 11M and 11C only during color image formation.

Secondary transfer roll 19A is in pressure contact with endless belt-shaped intermediate transfer body unit 18 only when image support P passes through secondary transfer roll 19A to perform secondary transfer.

Image forming units 10Y, 10M, 10C and 10BK are disposed in series in a vertical direction. Endless belt-shaped intermediate transfer body unit 18 is disposed on the left side of photoreceptors 11Y, 11M, 11C and 11K as illustrated. Endless belt-shaped intermediate transfer body unit 18 includes endless belt-shaped intermediate transfer body 180 capable of rotating by winding around rolls 181, 182, 183, 184, 186 and 187, primary transfer rolls 15Y, 15M, 15C and 15K, and cleaning unit 189.

In this way, toner images are formed on photoreceptors 11Y, 11M, 11C and 11K by charge, exposure and development, toner images of respective colors are superimposed on one another on endless belt-shaped intermediate transfer body 180, collectively transferred to image support P, and pressurized and heated to be fixed by fixation device 24. Photoreceptors 11Y, 11M, 11C and 11K after toner images are transferred to image support P are cleared of toners left on the photoreceptors during transfer using cleaners 16Y, 16M, 16C and 16Bk, and the cycles of charge, exposure and development described above are started, so that next image formation is performed.

Image support P is also called a transfer material or recording material, and is not particularly limited as long as toner images can be formed thereon by an electrophotographic image formation method. Specific examples of the image support include those that are publicly known, for example, plain paper ranging from thin paper to thick paper, fine quality paper, art paper, coated printing paper such as coated paper, commercially available Japanese paper, postcard paper, plastic films for OHP and cloth. In this example, fine quality paper was used.

<Process Conditions of Image Forming Apparatus of FIG. 2>

System speed: 45 cm/s

Photoreceptor: negatively charged OPC

Charge potential: −650 V

Development voltage (development roller applied voltage): −420 V

Primary transfer voltage (transfer roller applied voltage): +600 V

Secondary transfer voltage: +1200 V

Pre-development corona CIIG: appropriately adjusted at a needle applied voltage of −3 to 5 kV.

<Outline of Process in Image Forming Apparatus of FIG. 2>

FIG. 2 is a schematic conceptual view of an electrophotographic image forming apparatus 101. First, a liquid developer 102 is scraped off by a regulation blade 104 to form a thin layer of liquid developer 102 on a development roller 103. Thereafter, toner particles are moved in the nip between development roller 103 and a photoreceptor 105, so that a toner image is formed on photoreceptor 105.

Then, toner particles are moved in the nip between photoreceptor 105 and an intermediate transfer body 106, so that a toner image is formed on intermediate transfer body 106. Subsequently, toners are superimposed on one another on intermediate transfer body 106 to form an image on a recording material 110. The image on recording material 110 is then fixed by a heat roller 111 (170° C.×nip time 30 msec).

Image forming apparatus 101 includes a cleaning blade 107, a charge device 108 and a backup roller 109 in addition to the above-mentioned units.

12. Evaluation

<Image Density>

An average of image densities of the above-mentioned 10 sheets of solid images (average for total 50 locations with measurement performed at 5 locations per one sheet) was determined for each of the dry developers 1 to 6 and the liquid developers 1 to 26 prepared as described above using a reflection densitometer (trade name: "SpectroEye," manufactured by X-Rite Inc.).

Ranking evaluation was performed based on the following three grades. The results are shown in Table 5. A higher image density indicates that a proper image density was obtained.

(When the colorant is a yellow pigment)

A: image density is greater than or equal to 1.2

B: image density is greater than or equal to 1.1 and less than 1.2

C: image density is less than 1.1

(When the colorant is a cyan pigment)

A: image density is greater than or equal to 1.6

B: image density is greater than or equal to 1.5 and less than 1.6

C: image density is less than 1.5

(When the colorant is a magenta pigment)

A: image density is greater than or equal to 1.5

B: image density is greater than or equal to 1.4 and less than 1.5

C: image density is less than 1.4

<Fixation Strength>

For each of the dry developers 1 to 6 and the liquid developers 1 to 26 prepared as described above, an eraser (trade name: ink eraser "LION 26111," manufactured by LION OFFICE PRODUCTS CORP.) was rubbed against the above-mentioned 10 sheets of solid images twice under a pressing load of 1 kgf, the residual ratio of image density was measured by a reflection densitometer (trade name: "X-Rite model 404," manufactured by X-Rite Inc.), and ranking evaluation was performed for the average of the 10 sheets based on the following four grades.

A: image density residual ratio is greater than or equal to 90%

B: image density residual ratio is greater than or equal to 80% and less than 90%

C: image density residual ratio is greater than or equal to 75% and less than 80%

D: image density residual ratio is less than 75%

A higher image density residual ratio indicates a better image fixation strength. The results are shown in Table 5.

TABLE 5

| | Colorant dispersion | Image density | Fixation strength |
|---|---|---|---|
| Liquid developer 1 | Y1 | A | A |
| Liquid developer 2 | Y2 | B | A |
| Liquid developer 3 | Y3 | A | A |

TABLE 5-continued

| | Colorant dispersion | Image density | Fixation strength |
|---|---|---|---|
| Liquid developer 4 | Y4 | A | A |
| Liquid developer 5 | Y5 | B | A |
| Liquid developer 6 | Y6 | B | B |
| Liquid developer 7 | Y7 | A | A |
| Liquid developer 8 | Y8 | B | A |
| Liquid developer 9 | Y1 | A | B |
| Liquid developer 10 | Y6 | B | C |
| Liquid developer 11 | C1 | A | A |
| Liquid developer 12 | C2 | B | A |
| Liquid developer 13 | M1 | A | A |
| Liquid developer 14 | M2 | B | C |
| Liquid developer 15 | Y9 | B | A |
| Liquid developer 16 | Y10 | B | A |
| Liquid developer 17 | C3 | B | B |
| Liquid developer 18 | Y11 | B | C |
| Liquid developer 19 | Y12 | B | C |
| Liquid developer 20 | Y13 | B | C |
| Liquid developer 21 | *Y18 | C | D |
| Liquid developer 22 | *Y19 | C | D |
| Liquid developer 23 | *Y20 | C | D |
| Liquid developer 24 | *C4 | C | D |
| Liquid developer 25 | *M3 | C | D |
| Liquid developer 26 | *Y21 | C | D |
| Dry developer 1 | Y14 | A | A |
| Dry developer 2 | Y15 | B | B |
| Dry developer 3 | Y16 | A | B |
| Dry developer 4 | Y17 | B | A |
| Dry developer 5 | *Y22 | C | D |
| Dry developer 6 | *Y23 | C | D |

Note)
The * mark indicates a comparative example.

In Table 5, the types of colorant dispersions included in the developers are also shown so that developers corresponding to examples of the present invention and developers corresponding to comparative examples are clarified. That is, as is apparent when referring to Tables 2 and 5, it could be confirmed that developers including colorant dispersions as examples of the present invention show a proper image density and a high fixation strength as compared to developers including colorant dispersions as comparative examples.

<Color Phase>

The color phase was evaluated using the above-mentioned 10 sheets of solid images for each of the dry developers 1 to 12 and the liquid developers 1 to 52 prepared as described above. Specifically, a color difference ΔE was determined from an average of color phases of 10 sheets of solid images using a color-difference meter (trade name: "CM-3700d," manufactured by KONICA MINOLTA, INC.) for each of pairs of two developers shown in Table 6 below (a combination using the same colorant dispersion except for a difference as to whether the colorant dispersion is used immediately after or ten days after being produced, such as, for example, the dry developer 1 and the dry developer 7).

The color difference ΔE was the square root of the sum of values each obtained by squaring a difference on the L* axis, the a* axis and the b* axis in the uniform color space of the L*a*b* color system defined in JIS Z 8729.

Samples with a color difference ΔE of less than 1 are rated "A," samples with a color difference ΔE of greater than or equal to 1 and less than 2 are rated "B," samples with a color difference ΔE of greater than or equal to 2 and less than 3 are rated "C," and samples with a color difference ΔE of greater than or equal to 3 are rated "D." A smaller color difference ΔE indicates a better color phase. The results are shown in Table 6 below.

TABLE 6

| Pair of developers | Colorant dispersion | Color difference ΔE |
|---|---|---|
| Liquid developer 1/liquid developer 27 | Y1 | A |
| Liquid developer 2/liquid developer 28 | Y2 | B |
| Liquid developer 3/liquid developer 29 | Y3 | A |
| Liquid developer 4/liquid developer 30 | Y4 | A |
| Liquid developer 5/liquid developer 31 | Y5 | B |
| Liquid developer 6/liquid developer 32 | Y6 | B |
| Liquid developer 7/liquid developer 33 | Y7 | A |
| Liquid developer 8/liquid developer 34 | Y8 | B |
| Liquid developer 9/liquid developer 35 | Y1 | A |
| Liquid developer 10/liquid developer 36 | Y6 | B |
| Liquid developer 11/liquid developer 37 | C1 | A |
| Liquid developer 12/liquid developer 38 | C2 | B |
| Liquid developer 13/liquid developer 39 | M1 | A |
| Liquid developer 14/liquid developer 40 | M2 | C |
| Liquid developer 15/liquid developer 41 | Y9 | B |
| Liquid developer 16/liquid developer 42 | Y10 | B |
| Liquid developer 17/liquid developer 43 | C3 | B |
| Liquid developer 18/liquid developer 44 | Y11 | C |
| Liquid developer 19/liquid developer 45 | Y12 | B |
| Liquid developer 20/liquid developer 46 | Y13 | C |
| Liquid developer 21/liquid developer 47 | *Y18 | D |
| Liquid developer 22/liquid developer 48 | *Y19 | D |
| Liquid developer 23/liquid developer 49 | *Y20 | D |
| Liquid developer 24/liquid developer 50 | *C4 | D |
| Liquid developer 25/liquid developer 51 | *M3 | D |
| Liquid developer 26/liquid developer 52 | *Y21 | D |
| Dry developer 1/dry developer 7 | Y14 | A |
| Dry developer 2/dry developer 8 | Y15 | B |
| Dry developer 3/dry developer 9 | Y16 | A |
| Dry developer 4/dry developer 10 | Y17 | B |
| Dry developer 5/dry developer 11 | *Y22 | D |
| Dry developer 6/dry developer 12 | *Y23 | D |

Note)
The * mark indicates a comparative example.

In Table 6, the types of colorant dispersions included in the developers are also shown so that developers corresponding to examples of the present invention and developers corresponding to comparative examples are clarified. That is, as is apparent when referring to Tables 2 and 6, it was confirmed that developers including colorant dispersions as examples of the present invention show a good color phase as compared to developers including colorant dispersions as comparative examples.

While embodiments and examples of the present invention have been described above, it has been originally conceived that the configurations of the foregoing embodiments and examples are appropriately combined.

Although embodiments of the present invention have been described, it should be understood that embodiments disclosed herein are illustrative in all respects, and are not to be taken by way of limitation. The scope of the present invention is interpreted by the terms of the appended claims, and all changes in the meaning and scope equivalent to claims are intended to be encompassed.

What is claimed is:

1. An electrostatic latent image developer comprising: a resin, a colorant and a colorant dispersant, wherein said colorant dispersant contains a first polymer compound containing a constitutional unit derived from a monomer A, a constitutional unit derived from a monomer B and a constitutional unit derived from a monomer C, said monomer A is 4-vinylpyridine, said monomer B is $CH_2{=}CR^1{-}COOR^2$ (where $R^1$ represents hydrogen or a methyl group; and $R^2$ represents an alkyl group having 1 to 10 carbon atoms), and said monomer C is $CH_2{=}CR^3{-}COOR^4$ (where $R^3$ represents hydrogen or a methyl group; $R^4$ represents $(CH_2CH_2O)_nCH_3$ or $(CH_2CH_2O)_nCH_2CH_3$; and n represents an integer of 12 to 18).

2. The electrostatic latent image developer according to claim 1, wherein said monomer A is 4-vinylpyridine, said monomer B is n-butyl acrylate or n-butyl methacrylate, and said monomer C is $CH_2{=}CR^3{-}COOR^4$ (where $R^3$ represents hydrogen or a methyl group; and $R^4$ represents $(CH_2CH_2O)_{15}CH_3$).

3. The electrostatic latent image developer according to claim 1, wherein said resin is a polyester resin having an acid value of 2 to 50 mgKOH/g.

4. The electrostatic latent image developer according to claim 1, wherein said colorant dispersant further contains a second polymer compound, and said second polymer compound is a basic polymer compound containing a constitutional unit derived from ε-caprolactone.

5. The electrostatic latent image developer according to claim 4, wherein the content of said second polymer compound is 5 to 200% by mass with respect to said first polymer compound.

* * * * *